US012232661B1

(12) United States Patent
Bickel et al.

(10) Patent No.: US 12,232,661 B1
(45) Date of Patent: Feb. 25, 2025

(54) BATH SEAT APPARATUS

(71) Applicant: Regalo International, LLC, Burnsville, MN (US)

(72) Inventors: Shannon R. Bickel, Lakeville, MN (US); Kasey L. Pipo, Elko New Market, MN (US)

(73) Assignee: Regalo International LLC, Burnsville, MN (US)

( * ) Notice: Subject to any disclaimer, the term of this patent is extended or adjusted under 35 U.S.C. 154(b) by 270 days.

(21) Appl. No.: 17/717,095

(22) Filed: Apr. 10, 2022

Related U.S. Application Data

(60) Provisional application No. 63/197,981, filed on Jun. 7, 2021.

(51) Int. Cl.
*A47K 3/12* (2006.01)

(52) U.S. Cl.
CPC ..... *A47K 3/122* (2013.01)

(58) Field of Classification Search
CPC ..... A47K 3/122; A47K 3/127; A47K 3/064; A47K 3/074; A47K 3/125
See application file for complete search history.

(56) References Cited

U.S. PATENT DOCUMENTS

| | | | | | |
|---|---|---|---|---|---|
| 1,510,471 | A * | 10/1924 | Faerber | A45D 19/04 | 4/522 |
| 2,237,177 | A * | 4/1941 | Fischer | A47K 3/127 | 4/572.1 |
| 2,671,908 | A * | 3/1954 | Tronic | A47K 3/122 | 4/579 |
| 3,528,111 | A * | 9/1970 | Chou | A47K 3/034 | 4/572.1 |
| 5,809,588 | A * | 9/1998 | Angelotti | A47K 3/064 | 4/572.1 |
| 9,867,479 | B2 * | 1/2018 | Kaplan | A47K 3/127 | |
| 10,568,465 | B2 * | 2/2020 | Fusco | A47K 3/127 | |
| 2018/0325324 | A1 | 11/2018 | Fusco et al. | | |

FOREIGN PATENT DOCUMENTS

| | | | | |
|---|---|---|---|---|
| GB | 2555160 | A * | 4/2018 | A47K 3/122 |
| WO | 2018208901 | A1 | 11/2018 | |

* cited by examiner

*Primary Examiner* — Erin Deery

(57) ABSTRACT

A bath seat apparatus for being engaged in a bath tub that includes a frame having a receptacle for a child, first, second, third and fourth arms extending from the frame for engaging sides of the bath tub, and first, second, third, and fourth drivers engaged to the frame for driving respective first, second, third, and fourth arms to the frame and away from the sides of the bath tub and away from the frame and to the sides of the bath tub.

17 Claims, 28 Drawing Sheets

BATH SEAT APPARATUS

This application claims the benefit under 35 U.S.C. 119 (e) of U.S. Provisional Patent Application No. 63/197,981 filed Jun. 7, 2021, which is hereby incorporated by reference in its entirety into this application.

FIELD OF THE INVENTION

The present invention relates to a bath seat apparatus, more particularly a bath seat apparatus that engages an adult sized bath tub, and specifically to such a bath seat apparatus that safely holds a child therein for giving the child a bath in the adult sized bath tub.

BACKGROUND OF THE INVENTION

A gear is a rotating part having teeth, which teeth mesh with another toothed part to transmit torque. Torque is a twisting force.

A gear can mesh with a linear toothed part such as a rack, where a linear toothed part that is straight may be referred to as a straight rack and where a linear toothed part that is curved may be referred to as an arcuate rack.

When a gear meshes with a rack, translation is generated. The gear causes the rack to move linearly. A linear actuator is an actuator that creates motion in a straight line. A pinion may be a linear actuator.

One definition of a pinion is a gear with a small number of teeth designed to mesh with a larger wheel. Another definition of a pinion is a gear that is designed to mesh with a rack.

In most cases, the driver is the pinion and the follower is the rack. However, the driver may be the rack and the follower may be the pinion. In other words, in some rack and pinion mechanisms, driving the rack in a straight line by a third force or power source will cause the pinion to be driven into rotation.

A rack and pinion mechanism may use straight gears or helical gears. A straight gear may be a spur gear. In a helical gear, the leading edges of a tooth are not parallel to the axis of rotation but are set at an angle.

There are external gears and internal gears. An external gear is one with teeth formed on the outer surface of a gear, such as where a round gear includes a periphery and teeth extend outwardly from the periphery. An internal gear is one with teeth formed on the inner surface of a gear, such as where a round gear includes a peripheral lip and where the lip includes teeth extending toward an axis of the round gear.

Other gears include skew or crossed gears, double helical gears, bevel gears, spiral bevel gears, hypoid gears where the shaft axes do not intersect, crown gears or contrate gears, worm gears, non-circular gears, epicyclic gears where one or more of the gear axes move, sun and planet gears where reciprocating motion is converted into rotary motion, harmonic gears or strain wave gears, cage gears, and magnetic gears. Gears may or may not require lubrication.

SUMMARY OF THE INVENTION

A feature of the present invention is the provision in a bath seat apparatus, of the bath seat apparatus being engaged in a bath tub, where the bath tub includes first and second sides and a bottom.

Another feature of the present invention is the provision in a bath seat apparatus, of a frame having a receptacle for a child.

Another feature of the present invention is the provision in a bath seat apparatus, of first, second, third, and fourth arms extending from the frame.

Another feature of the present invention is the provision in a bath seat apparatus, of each of the first, second, third, and fourth arms having a distal end, where the distal ends of the first and second arms engage respective first and second sides of the bath tub, and where the distal ends of the third and fourth arms engage respective first and second sides of the bath tub.

Another feature of the present invention is the provision in a bath seat apparatus, of first, second, third, and fourth drivers that drive, respectively, the first, second, third, and fourth arms to and away from the frame having the receptacle for a child.

Another feature of the present invention is the provision in a bath seat apparatus, of the first, second, third, and fourth drivers being, respectively, first, second, third, and fourth gear assemblies.

Another feature of the present invention is the provision in a bath seat apparatus, of the first, second, third, and fourth gear assemblies including, respectively, first, second, third, and fourth pinons engaged to the frame.

Another feature of the present invention is the provision in a bath seat apparatus, of the first, second, third, and fourth gear assemblies including, respectively, first, second, third, and fourth racks.

Another feature of the present invention is the provision in a bath seat apparatus, of the first arm including the first rack, the second arm including the second rack, the third arm including the third rack, and the fourth arm including the fourth rack.

Another feature of the present invention is the provision in a bath seat apparatus, of the first arm including a first straight axis and of the second arm including a second straight axis, where the first and second axes are coaxial.

Another feature of the present invention is the provision in a bath seat apparatus, of the third arm including a third straight axis and of the fourth arm including a fourth straight axis, where the third and fourth axes are coaxial.

Another feature of the present invention is the provision in a bath seat apparatus, of each of the first, second, third, and fourth pinions including a face having an axis and a periphery, where the pinon is rotatable on the axis, where the face includes a first elongate spiral tooth having an inner end and an outer end, where the inner end of the first elongate spiral tooth is adjacent to the axis, and where the outer end of the first elongate spiral tooth is adjacent to the periphery.

Another feature of the present invention is the provision in a bath seat apparatus, of the face of the pinion including a second elongate spiral tooth having an inner end and an outer end, where the inner end of the second elongate spiral tooth is adjacent to the axis, where the outer end of the second elongate spiral tooth is adjacent to the periphery, where the first and second elongate spiral teeth are spaced apart from each other, where a portion of the first elongate tooth is disposed between the second elongate tooth and the periphery, and where a portion of the second elongate tooth is disposed between the first elongate tooth and the periphery.

Another feature of the present invention is the provision in a bath seat apparatus, of each of the first, second, third, and fourth racks including a set of teeth, where each of the teeth includes first and second ends, a top that extends between the first and second ends, a first side that extends between the first and second ends and that further extends from the top, and a second side that extends between the first and second ends and that further extends from the top, and where each of the first and second sides is curved from the first end to the second end.

Another feature of the present invention is the provision in a bath seat apparatus, of the frame including a front end and a rear end, where the first and second arms extend from the front end, where the third and fourth arms extend from the rear end, where the receptacle is between the front and rear ends, where the receptacle includes a bottom that faces the bottom of the bath tub, where the receptacle includes a pair of leg openings for the child, and where the leg openings are spaced apart from each other.

Another feature of the present invention is the provision in a bath seat apparatus, of the frame including a front end and a rear end, where the first and second arms extend from the front end, where the third and fourth arms extend from the rear end, where the receptacle is between the front and rear ends, where the receptacle includes a bottom that faces the bottom of the bath tub, where the bottom includes a bottom portion, where the bottom portion is disposed at a first elevation, where the receptacle includes a seat that is spaced from the bottom portion, where the seat includes perforations to permit water to pass through the seat, and where the perforations are at a greater elevation than the first elevation.

Another feature of the present invention is the provision in a bath seat apparatus, of the frame including a front end and a rear end, where the first and second arms extend from the front end, where the third and fourth arms extend from the rear end, where the receptacle is between the front and rear ends, where the receptacle includes a bottom that faces the bottom of the bath tub, where the bottom includes a bottom portion, where the bottom portion is disposed at a first elevation, where the receptacle includes a seat that is spaced from the bottom portion, where the seat bears a weight of the child and is disposed at a greater elevation or is disposed over greater elevations than the first elevation.

Another feature of the present invention is the provision in a bath seat apparatus, of the first, second, third, and fourth drivers including respective first, second, third, and fourth rotatable hand controls that when rotated drive the respective first, second, third, and fourth arms in a straight direction to and away from the frame, where the first and second hand controls face in a direction forwardly of the receptacle to minimize chances of a child operating the first and second hand controls, where the third and fourth hand controls face in a direction rearwardly of the receptacle to minimize chances of a child operating the third and fourth hand controls.

Another feature of the present invention is the provision in a bath seat apparatus, of the first, second, third, and fourth drivers including respective first, second, third, and fourth rotatable hand controls that when rotated drive the respective first, second, third, and fourth arms in a straight direction to and away from the frame, where the first, second, third, and fourth distal ends are driveable in to a position that is adjacent to the respective first, second, third, or fourth hand control that is driving the respective first, second, third, or fourth distal end.

Another feature of the present invention is the provision in a bath seat apparatus, of each of the first, second, third, and fourth pinions including a face that defines a plane, where the face includes an elongate tooth that engages one of the first, second, third, or fourth racks, where each of the first, second, third, and fourth racks includes an axis on which the rack axially slides, and where the face is obliquely disposed relative to the axis such that when a portion of the elongate tooth engages its respective rack another portion of the elongate tooth is disposed over the rack in a position that is disengaged from its respective rack.

Another feature of the present invention is the provision in a bath seat apparatus, of each of the first, second, third, and fourth pinions including a face that defines a plane, where the face includes an elongate tooth that engages one of the first, second, third, or fourth racks, where each of the first, second, third, and fourth racks includes a rack axis on which the rack axially slides, and where each of the first, second, third, and fourth pinions includes a pinion axis about which the pinion rotates, where the pinion axis is oblique relative to its respective rack axis face such that when a portion of the elongate tooth engages its respective rack another portion of the elongate tooth is disposed over the rack in a position that is disengaged from its respective rack.

Another feature of the present invention is the provision in a bath seat apparatus, of each of the first, second, third, and fourth pinions including an elongate tooth, where each of the first, second, third, and fourth racks includes a set of teeth, and where a first portion of the elongate tooth engages the set of teeth and, at the same time, a second portion of the elongate tooth is disposed adjacent to and over the set of teeth.

Another feature of the present invention is the provision in a bath seat apparatus, of each of the first, second, third, and fourth distal ends including a suction cup for engaging one of the first and second sides of the bath tub.

Another feature of the present invention is the provision in a bath seat apparatus, of the first driver including a first pinion and the first arm including a first rack, where the first pinion when in a rotating state engaging and driving the first rack to drive the first arm to and away from the frame, where the first pinion when in a nonrotating state engaging and locking the first rack against axial sliding to lock the first arm from being driven to and away from the frame, and where the first pinion unlocks the first rack for axial sliding and the first arm for being driven to and away from the frame when the first pinion begins to rotate.

Another feature of the present invention is the provision in a bath seat apparatus, of the second driver including a second pinion and the second arm including a second rack, where the second pinion when in a rotating state engaging and driving the second rack to drive the second arm to and away from the frame, where the second pinion when in a nonrotating state engaging and locking the second rack against axial sliding to lock the second arm from being driven to and away from the frame, and where the second pinion unlocks the second rack for axial sliding and the second arm for being driven to and away from the frame when the second pinion begins to rotate.

Another feature of the present invention is the provision in a bath seat apparatus, of the third driver including a third pinion and the third arm including a third rack, where the third pinion when in a rotating state engaging and driving the third rack to drive the third arm to and away from the frame, where the third pinion when in a nonrotating state engaging and locking the third rack against axial sliding to lock the third arm from being driven to and away from the frame, and where the third pinion unlocks the third rack for axial sliding and the third arm for being driven to and away from the frame when the third pinion begins to rotate.

Another feature of the present invention is the provision in a bath seat apparatus, of the fourth driver including a fourth pinion and the fourth arm including a fourth rack, where the fourth pinion when in a rotating state engaging and driving the fourth rack to drive the fourth arm to and away from the frame, where the fourth pinion when in a nonrotating state engaging and locking the fourth rack against axial sliding to lock the fourth arm from being driven to and away from the frame, and where the fourth pinion unlocks the fourth rack for axial sliding and the fourth arm for being driven to and away from the frame when the fourth pinion begins to rotate.

An advantage of the present invention is a safe child bath seat apparatus. One feature contributing to this advantage is the presence of four arms, where a set of two front arms oppose each other such that, when such front arms are tightened, the tightening forces oppose each other and where a set of two rear arms oppose each other such that, when such rear arms are tightened, the tightening forces oppose each other. Another feature contributing to this advantage is the placement of the seat of the child receptacle relatively deeply to dispose the seat of the apparatus on or adjacent to the floor of the adult sized bathtub. Another feature contributing to this advantage is that the knobs or hand controls for the drivers or linear actuators face away from the child receptacle so as to minimize accessibility of the knobs or hand controls for the child in the child receptacle and maximize accessibility of the knobs or hand controls for the caretaker. Another feature contributing to this advantage is that, unless the pinions are rotating, the pinions are working as locks against the arms sliding in and against the arms sliding out such that the only force that can drive the arms in and out are the respective pinions of the arms.

Another advantage of the present invention is that the gearing of the pinion and rack arrangement has been optimized. In other words, the pinion and rack arrangement tightens securely such that the suction cup distal ends of the arms tighten securely against the sides of the adult sized bath tub and, at the same time, the pinion and rack arrangement drives or draws the distal ends outwardly and inwardly relatively quickly.

Another advantage of the present invention is that the bath seat apparatus is simple to operate.

Another advantage of the present invention is that the bath seat apparatus is simple and inexpensive to manufacture.

BRIEF DESCRIPTION OF THE DRAWINGS

FIG. 6 is a perspective detail view of the bath tub apparatus of FIG. 5, where arms of the bath seat apparatus have been drawn in.

FIG. 8 is a top detail view of the bath seat apparatus of FIG. 5, where arms of the bath seat apparatus have been drawn in.

FIG. 10 is a bottom detail view of the bath seat apparatus of FIG. 5, where arms of the bath seat apparatus have been drawn in.

FIG. 12 is a front detail view of the seat tub apparatus of FIG. 5, where arms of the bath seat apparatus have been drawn in.

FIG. 23B is a perspective, assembled, rear view of the front end of the bath seat apparatus of FIG. 23A, where the arms of the bath seat apparatus have been drive in.

FIG. 24C is a rear elevation view of the front end of the bath seat apparatus of FIG. 24A with the arms driven in.

DESCRIPTION

Figure 1:
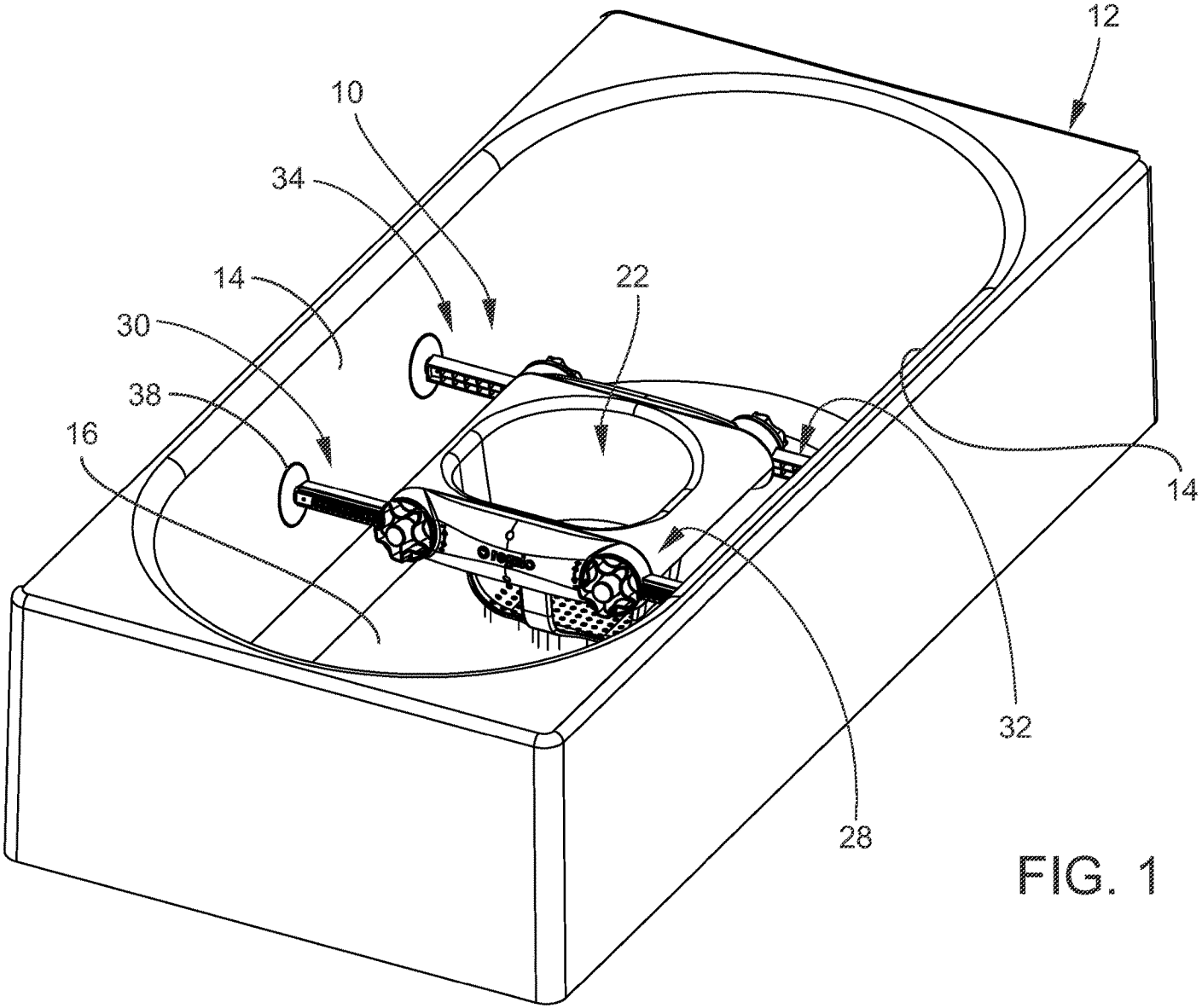
FIG. 1 is a perspective view of the present bath seat apparatus engaged in a bath tub.
Figure 2:
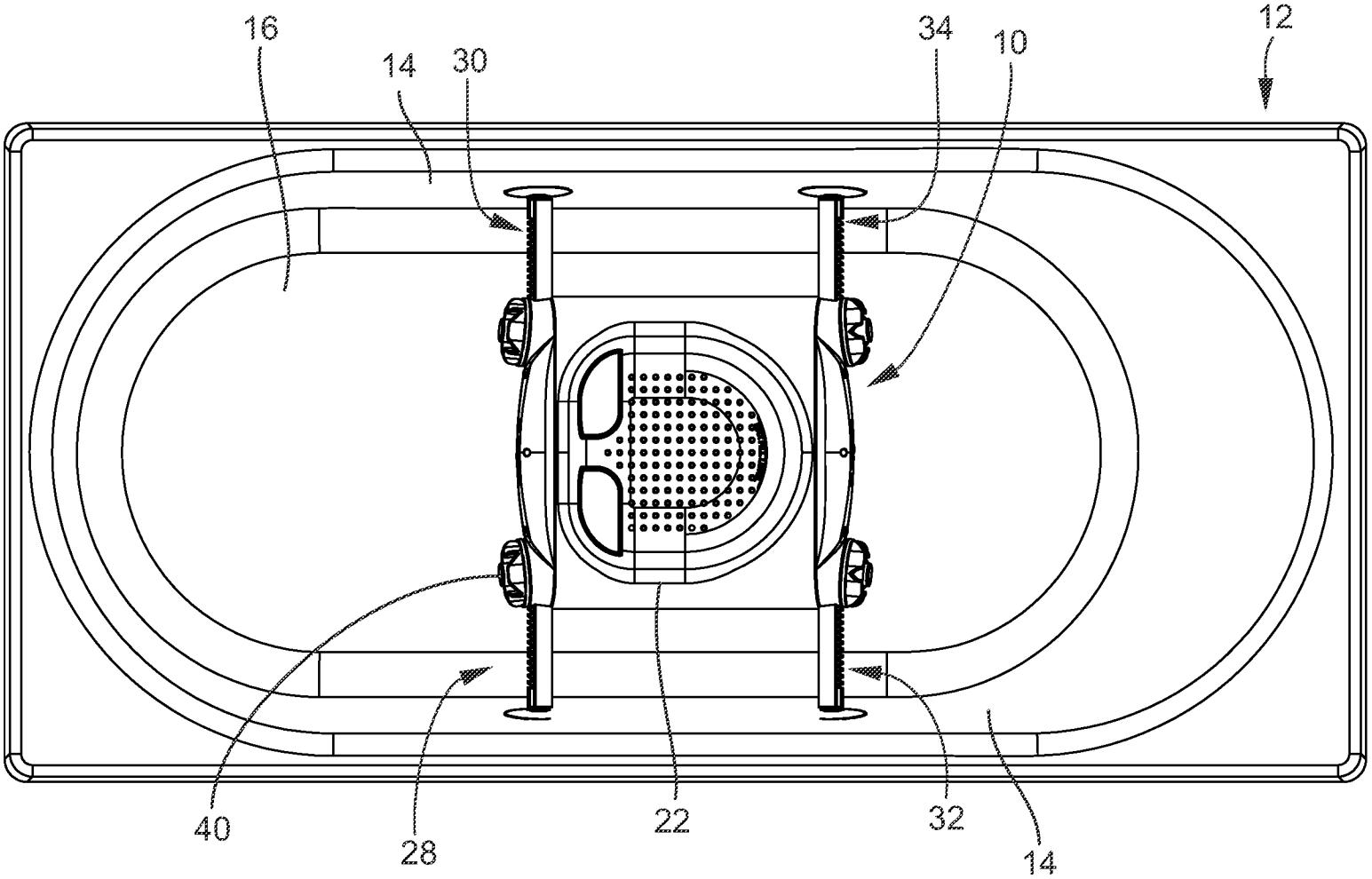
FIG. 2 is top view of the bath seat apparatus and bath tub of FIG. 1.
Figure 3:
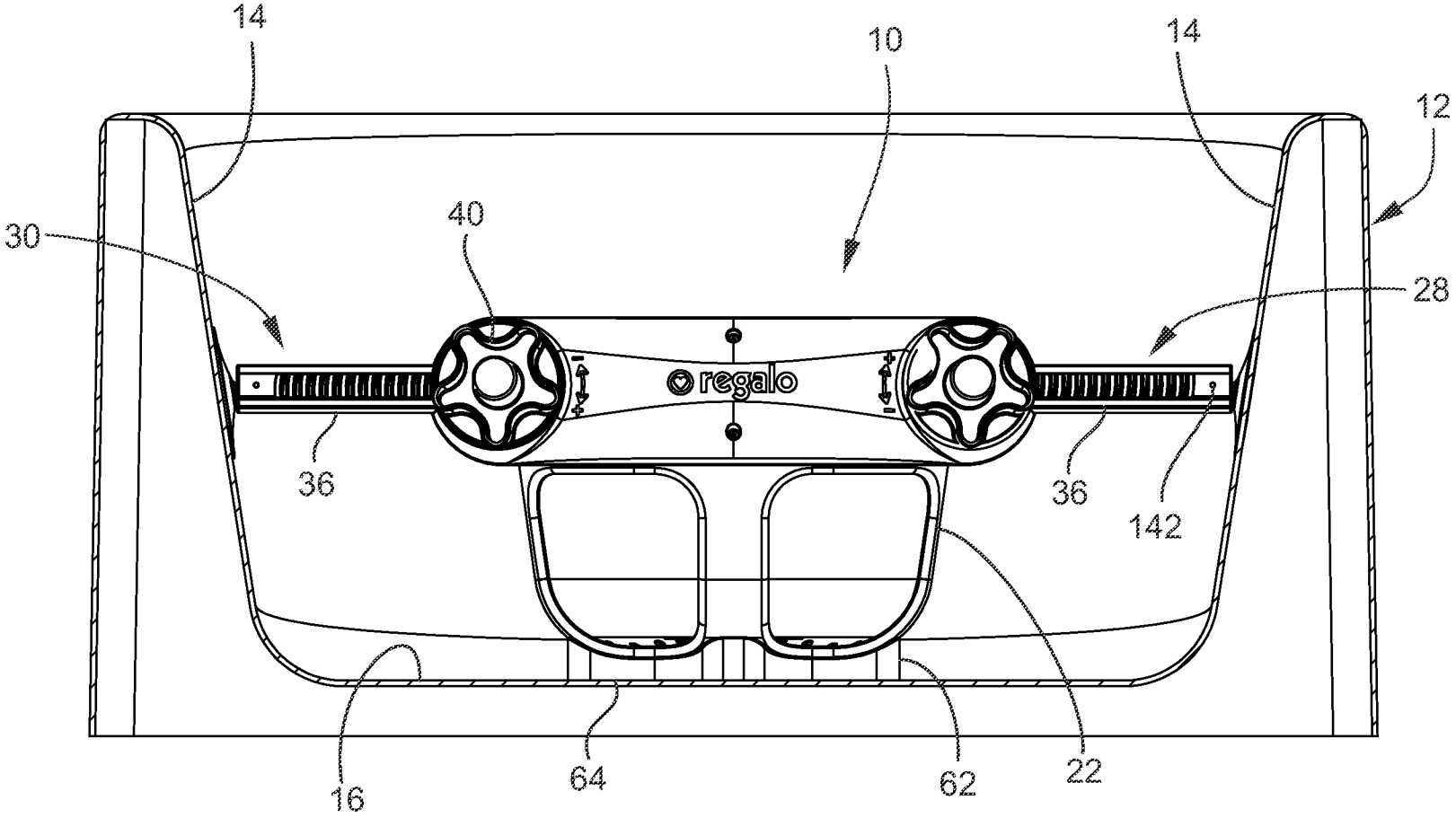
FIG. 3 is a front view of the bath seat apparatus of FIG. 1 with the bath tub of FIG. 1 cut away.
Figure 4:
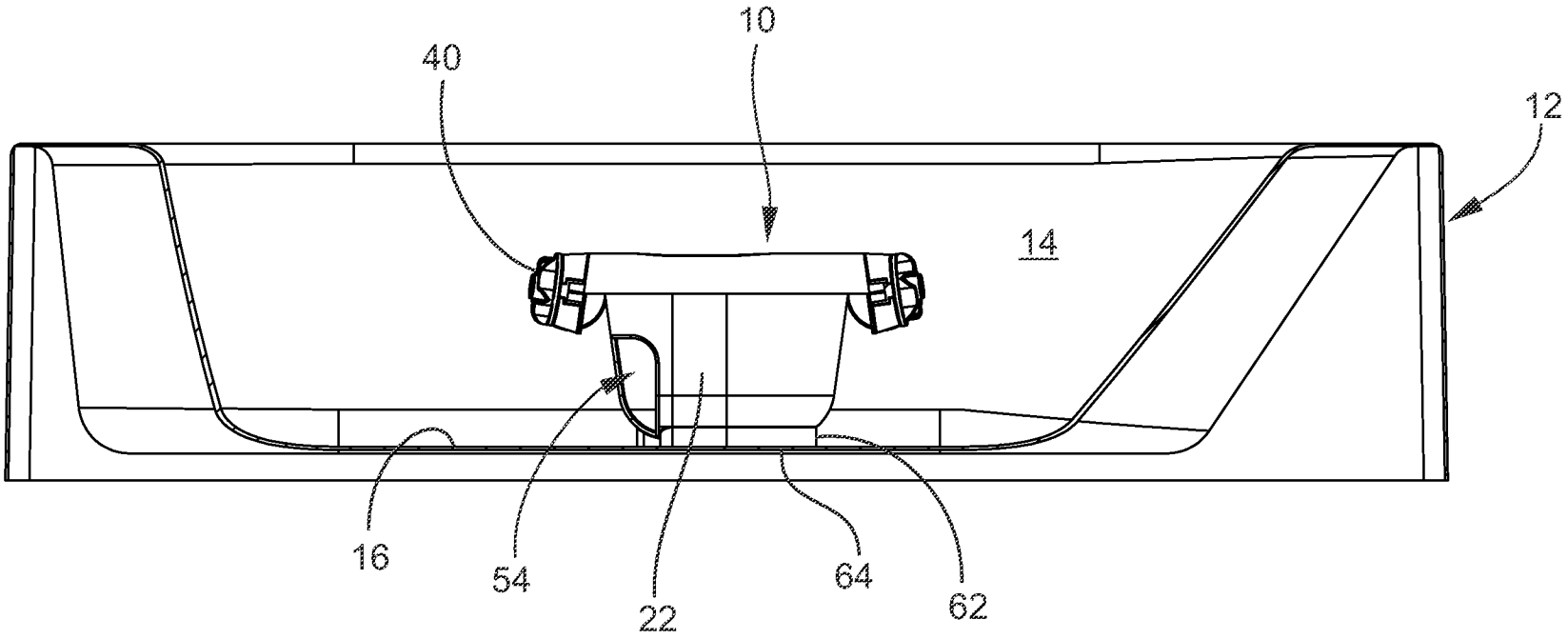
FIG. 4 is a side section view of the bath seat apparatus and bath tub of FIG. 1.

As shown in FIGS. 1-4, the present bath seat apparatus is indicated by the reference number 10. The bath seat apparatus 10 is engaged in an adult sized bath tub 12 having inner sides 14 and an inner bottom 16. FIG. 1 shows a perspective view of bath seat apparatus 10 engaged in the bath tub 12. FIG. 2 shows a top view of the bath seat apparatus 10 engaged in the bath tub 12. FIG. 3 shows a section view of the bath tub 12 and a front view of the bath seat apparatus 10. FIG. 4 shows a section view of the bath tub 12 and a section view of the bath seat apparatus 10.

Figure 5:
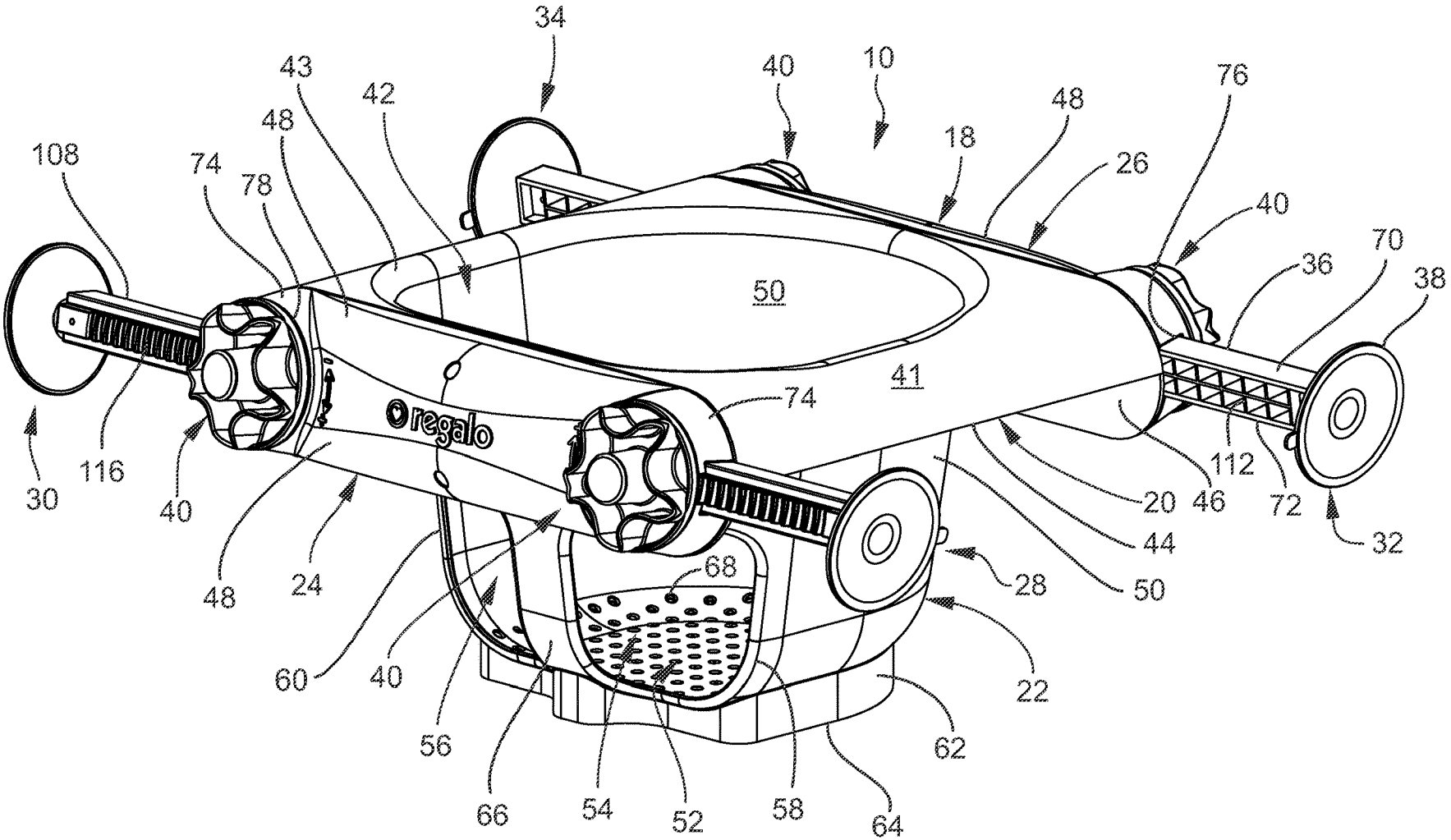
FIG. 5 is a perspective detail view of the bath tub apparatus of FIG. 1, where arms of the bath seat apparatus have been drawn out.

As shown in greater detail in FIG. 5, bath seat apparatus 10 includes a frame 18. Frame 18 includes a base or frame upper portion 20 from which a child receptacle 22 depends. Frame 18 includes a front end portion 24 and a rear end portion 26. Frame end portions 24, 26 are integral with frame upper portion or base 20.

First and second arms 28, 30 are engaged to and extend from the front frame end portion 24. Third and fourth arms 32, 34 are engaged to and extend from the rear frame end portion 26. Each of the arms 28, 30, 32, 34 includes a rack portion 36 and a suction cup portion 38. Suction cup portion 38 is the distal end of each of the arms 28, 30, 32, 34. A pinion 40 is engaged to each of the rack portions 36 and further engaged to the frame 18. The pinions 40 for first and second arms 28, 30 are engaged to the front frame end portion 24. The pinions 40 for the third and fourth arms 32, 34 are engaged to the rear frame end portion 26.

Pinion 40 may be referred to as a driver 40 or linear actuator 40.

Base 20 or frame upper portion 20 supports the child receptacle 22 and further supports the front frame end portion 24 and the rear frame end portion 26. Base 20 includes an annular opening 42 defined by an annular edge 43. Base 20 extends laterally and longitudinally from the annular opening 42. As the base 20 extends laterally and outwardly from the annular opening 42, an arm rest portion 41 of the base 20 curves downwardly from a plane defined by the annular opening 42 of base 20. This arm rest portion of the base 20 curves outwardly and downwardly and then terminates at a straight line edge 44 on each of the sides of the base 20. One edge 44 extends longitudinally and has ends that terminate adjacent to arms 28 and 32. The opposite edge 44 extends longitudinally and has ends that terminate adjacent to arms 30 and 34 on the other side of the base 20. A front portion of the base 20 that extends longitudinally and forwardly from annular opening 42 terminates at the front frame end portion 24. A rear portion of the base 20 that extends longitudinally and rearwardly from annular opening 42 terminates at the rear frame end portion 26. Base 20 is one-piece and integral with front and rear frame end portions 24, 26.

Figure 15:
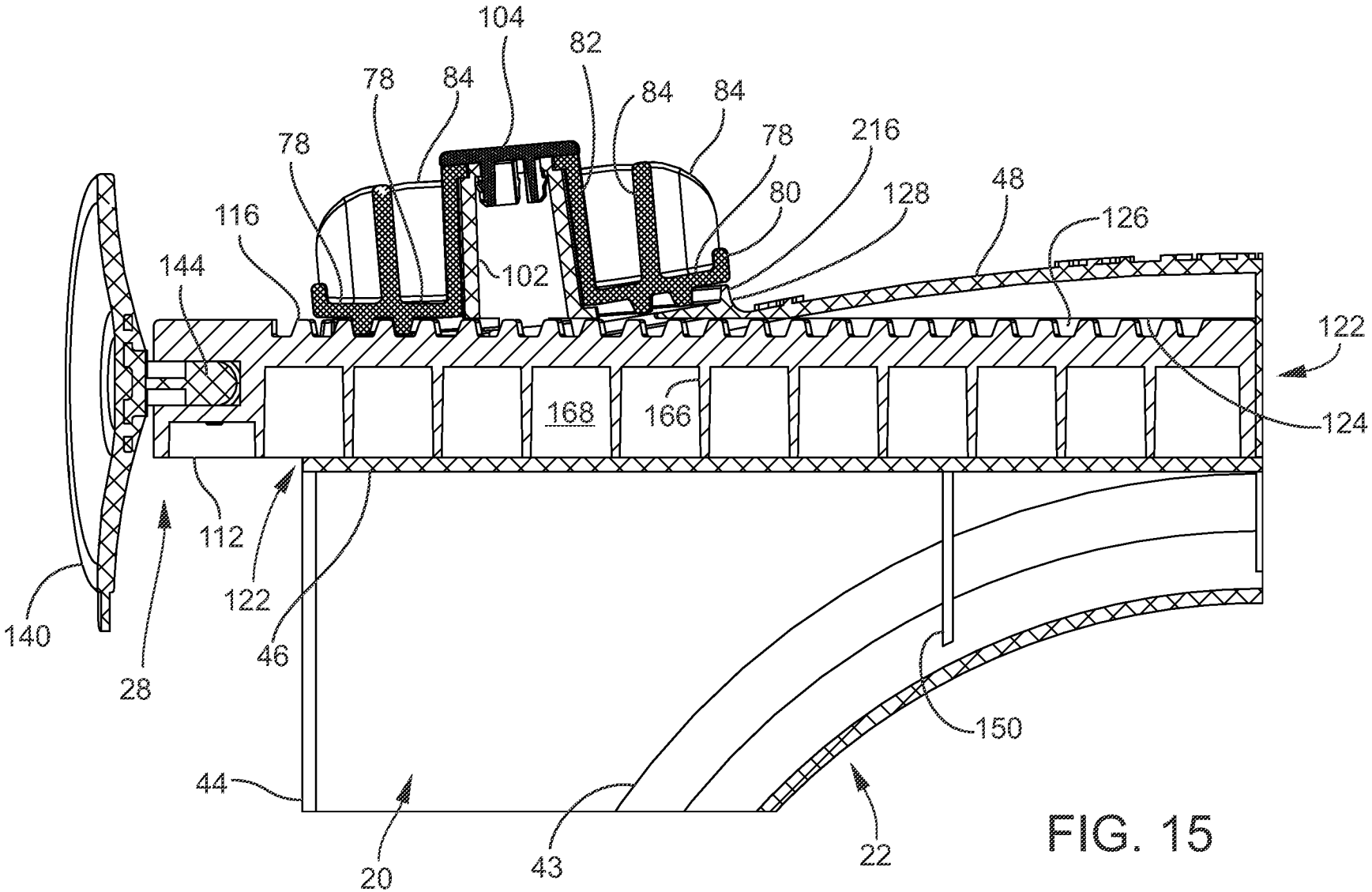
FIG. 15 is a detail, partially section, view of one of the arm assemblies of the bath seat apparatus of FIG. 5, where the arm assembly includes a pinion, pinion teeth, a rack, rack teeth and a suction cap.

FIG. 15 shows an inner plate section 46 that forms a portion of the front frame end portion 24. FIG. 5 shows this inner plate section 46 of the rear frame end portion 26. Inner plate section 46 is section of a guide for the rack portion 36 of the arms 28, 30, 32, 34.

Opposite of plate section 46 is an outer curved frame section 48. Curved frame section 48 is shown in both of FIG. 5 and FIG. 15. Each of front frame end portion 24 and rear frame end portion 26 has this outer curved frame section 48.

Child receptacle 22 depends from base 20 and is spaced from each of the front frame end portion 24 and the rear frame end portion 26. Child receptacle 22 includes a sidewall that includes a U-shaped sidewall portion 50 that extends from annular edge 43 to a seat 52. The U-shaped sidewall portion 50 extends about the rear and sides of a child's torso. The child's arms extend adjacent to and over the outer portions of the base 20 that extend laterally, outwardly, and downwardly from the annular edge 43. The legs and rear end of a child are supported by the seat 52. The legs of a child extend though respective leg openings 54, 56 formed, respectively, by leg opening edges 58, 60. Depending from the seat 52 is a seat bottom 62 having a bottommost edge or portion 64.

The sidewall of the child receptacle 22 further includes a T-shaped front portion 66 that depends from annular edge 43 and then narrows to run between the leg openings 54, 56. The T-shaped front portion 66 confronts the chest and stomach regions of the torso of a child. The T-shaped front portion 66 and U-shaped sidewall portion 50 are integral with each other and are integral portions of a sidewall of the child receptacle 22.

Seat bottom 62 is an endless wall that depends from seat 52. The endless wall of seat bottom 62 undulates at a front portion where the endless wall runs adjacent to the leg openings 54, 56. Endless wall of seat bottom 62 is set inwardly of U-shaped sidewall portion 50 and is further set inwardly of T-shaped front sidewall portion 66. Endless wall of seat bottom 62 is vertically oriented so as to run parallel to an upright axis of opening 42. The axis of arms 28, 30, 32, 34 define a plane and the endless wall of seat bottom 62 runs at a right angle to this plane. The bottommost edge 64 of the endless wall of seat bottom 62 may be set on or may be adjacent to the inner bottom 16 of the bath tub 12. The bottommost edge 64 and endless wall of bottom 62 spaces the seat 52 of the child receptacle 22 from the inner bottom 16 of the bath tub 12 to permit water flow or water drainage through perforations 68 formed in the child receptacle 22. Some of the perforations 68 are in the seat 52, which seat 62 defines a plane. Some of the perforations 68 are in a bottom portion of the U-shaped sidewall portion 50, which portion curves upwardly and outwardly from the planar seat 62. The entirety of the child receptacle 22 is found within imaginary vertical lines extending downwardly from the periphery of the base 20. All of the child receptacle 22 is found between the front frame end portion 24 and the rear frame portion 26, i.e., between planes defined by vertical plane sections 46 of the front and rear end frame portions 24, 26.

Rack portion 36 includes an upper elongate wall 70 and a lower elongate wall 72. The front edges of the walls 70, 72 of the rack portions 36 of the rear arms 32, 34 slide on plate section 46 of the rear frame end portion 26. The rear edges of walls 70, 72 of the rack portions 36 of the front arms 28, 30 slide on the plate section 46 of the front frame end portion 24.

Frame 18 includes front frame end portion 24 that in turn includes a pair of partially cylindrical frame portions 74. Frame 18 includes rear frame end portion 26 that in turn also includes a pair of partially cylindrical frame portions 74. Partially cylindrical frame portion 74 includes a receptor 76 for receiving rack portion 36. The upper face of wall 70 and the lower face of wall 72 slides against edges that form the receptor 76. The rear edges of walls 70, 72 of the rack portion 36 of rear arms 32, 34 slide against a rear edge of receptor 76. The front edges of walls 70, 72 of the rack portion 36 of front arms 28, 30 slide against front edges of the receptor 76. Elongate straight faces 118, 120 also slide against front edges of the receptor 76. Inner ends of the rack portions 36 slide between the inner and outer plate sections 46, 48 of each of the front frame end portion 24 and rear frame end portion 26.

As shown in FIG. 15, each of the pinions 40 includes a base 78 having a circular outwardly extending peripheral lip 80. Base 78 includes a central opening 81 with an outer frustoconical central portion 82 forming the central opening and extending outwardly from the base 78. An undulating wall 84 endlessly undulates about the outer frustoconical central portion 82, is spaced from the outer frustoconical central portion 82, extends from the base 78, and integrally engages the peripheral lip 80. Undulating wall 84 provides surfaces for the thumb and fingers of a hand to pinch or grasp or engage when the thumb and fingers are rotating the pinion 40 clockwise or counterclockwise.

Figure 17:
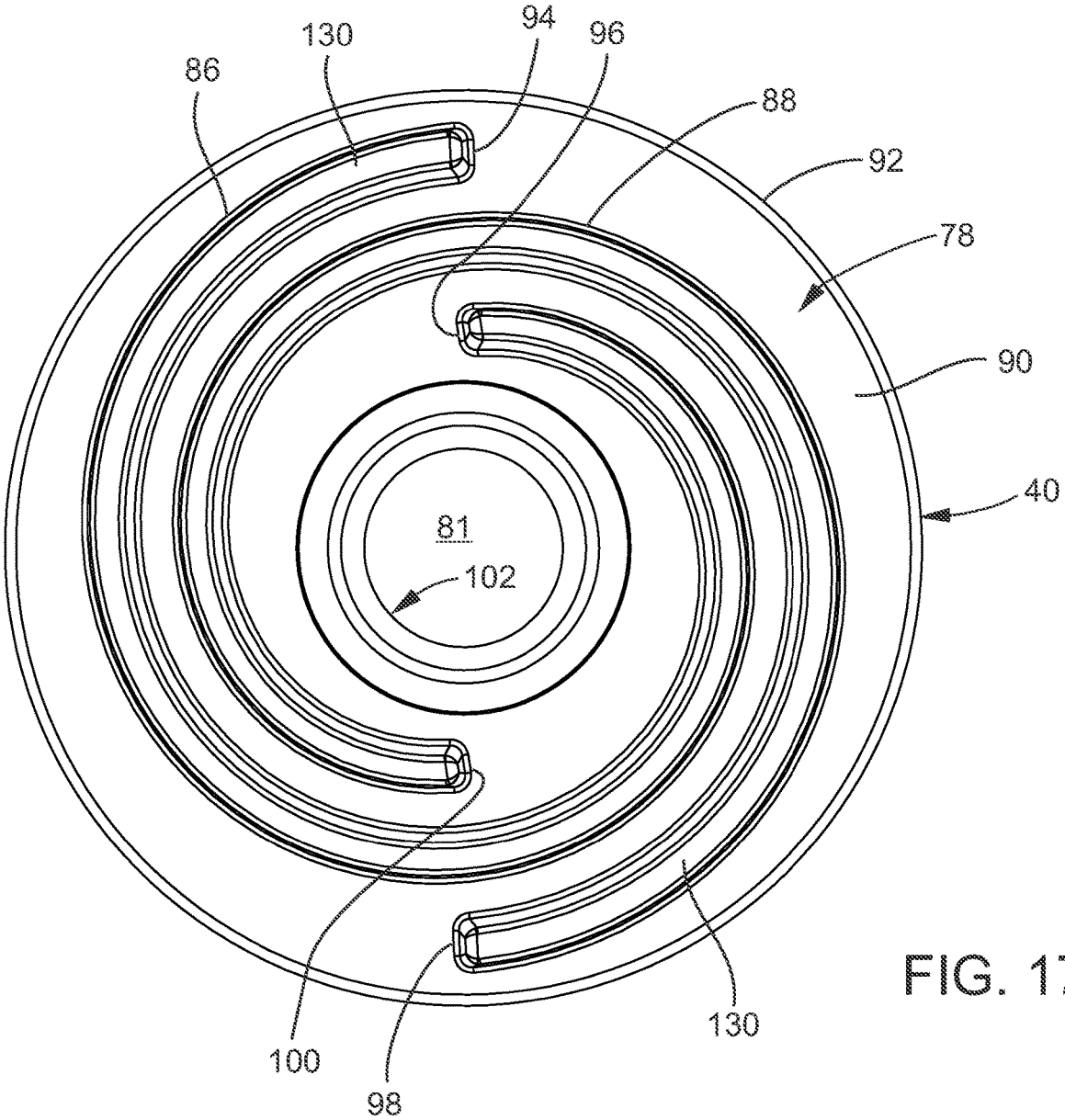
FIG. 17 is an isolated view of the inner face of the pinion of FIG. 16.

On one side of the base 78, pinion 40 includes the peripheral lip 80, undulating wall 84, and outer frustoconical central portion 82. On the other side of the base 78, as shown in FIG. 17, pinion 40 includes a pair of elongate spiral teeth or threads 86, 88 extending from a flat planar face 90 and winding about each other on the face 90. Flat planar face 90 includes a periphery having a peripheral radius 92 that leads into the outside face of peripheral lip 80. Elongate spiral tooth or thread 86 includes an outer end 94 adjacent to the periphery of base 78 and an inner end 96 adjacent to central opening 81 having the axis about which the pinion 40 rotates. Elongate spiral tooth or thread 88 includes an outer end 98 adjacent to a periphery of base 78 and an inner end 100 adjacent to central opening 81 having the axis about which the pinion 40 rotates. All portions of elongate spiral tooth or thread 86 are spaced from all portions of elongate spiral tooth or thread 88. A portion of elongate spiral tooth or thread 86 is disposed between the elongate spiral tooth or thread 88 and the periphery of the base 78. A portion of the elongate spiral tooth or thread 88 is disposed between the elongate spiral tooth or thread 86 and the periphery of the base 78.

It should be noted that one definition of spiral is: a winding in a continuous and gradually widening (or tightening) curve, either around a central point on a flat plane or about an axis so as to form a cone. Here all portions of the spiral elongate tooth or thread 86 or 88 are engaged on a flat plane, i.e., base surface 90, with the central point being on an axis of opening 81.

Each of the teeth 86, 88 extends from the face 90 of base 78 a uniform distance from end to end, except at the absolute ends 94, 96, 98, 100 where the absolute end includes a radius so as to guide an initial engagement with teeth of rack portion 36. The height or depth of teeth 86, 88 is the same for each of the main bodies of the teeth 86 and 88.

As shown in FIG. 15, outer plate section 48 includes an inner frustoconical portion 102 that is stationary. Outer frustoconical portion 82 of pinion 40 rotatably engages inner frustoconical portion 102. Inner frustoconical portion 102 includes an inwardly extending lip disposed at the outer end of the outer frustoconical portion 102. Barbs of a retaining cap 104 engage this inwardly extending lip of the outer frustoconical portion 102. Retaining cap 104 includes a disk shaped end. Extensions protrude from the inner face of this disk shaped end of retaining cap 104 into the inner frustoconical portion 102. The barbs extend laterally from these extensions. If desired, such an extension may be a singular cylindrical structure and the barb may be a singular annular barb that engages the inwardly extending lip of the frustoconical portion 102. The periphery of the disk shaped end of the retaining cap 104 covers the outer circular end of the outer frustoconical structure 82 to lock the pinion 40 on to the inner frustroconcial portion 102 as the barbs of the retaining cap 104 lock under the inner peripheral lip of the inner frustoconical portion 102.

Rack portion 36 includes a base 106 with first and second flat, smooth, planar sides. A first of these sides is a top side 108 shown in FIG. 7 and further shown in FIG. 5. A second of these flat, smooth, planar sides is bottom side 110 shown in FIG. 9.

Rack portion 36 further includes a ribbed, third side 112. This ribbed side 112, having edges of exposed ribs, is an inner side and runs at a right angle to the top and bottom sides 108, 110. The ribs and the edges of the ribs run at right angles to each other. This ribbed side 112 is shown in FIG. 5.

Figure 11:
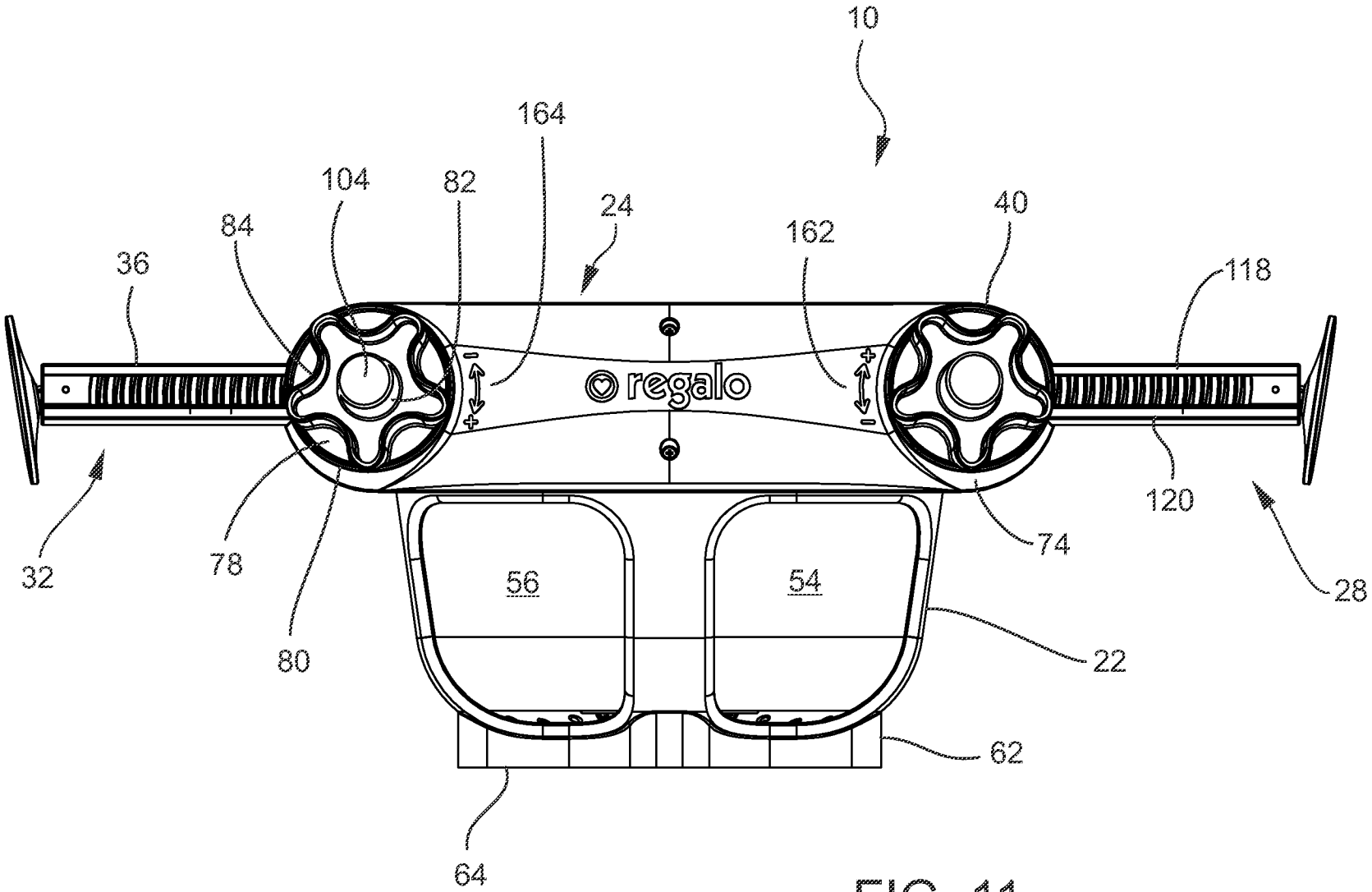
FIG. 11 is a front detail view of the bath seat apparatus of FIG. 5, where arms of the bath seat apparatus have been drawn out.

As shown in FIG. 11, rack portion 36 further includes a toothed, fourth side 114. Toothed fourth side 114 includes a straight row of teeth 116. Toothed fourth side 114 further includes a pair of upper and lower straight elongate faces 118, 120 running on either side of the straight row of teeth 116. Teeth 116 are exposed and extend from a plane defined by the pair of upper and lower straight elongate faces 118, 120. The teeth 116 of first and second arms 28, 30 extend forwardly and outwardly away from the child receptacle 22. The teeth 116 of the third and fourth arms 32, 34 extend rearwardly and outwardly away from the child receptacle 22.

As indicated above, 1) FIG. 15 shows the inner plate section 46 that forms a portion of the front frame end portion 24, 2) FIG. 5 shows this inner plate section 46 of the rear frame end portion 26, and 3) inner plate section 46 is a section of a guide for the rack portion 36 of the arms 28, 30, 32, 34. Inner plate section 46 is a guide for the ribbed third side 112. The opposite side of the ribbed third side 112 is the fourth side having the straight row of teeth 116 and the elongate straight faces 118, 120. A guide for this fourth side includes a vertical frame portion 124, as shown in FIG. 15. Vertical frame portion 124 opposes inner plate section 46.

There are four straight receptors 122 formed in frame 18, two opposing receptors 122 formed in the front end frame portion 24 for arms 28 and 30 and two opposing receptors 122 formed in the rear end frame portion 26 for arms 32, 34.

Figure 21:
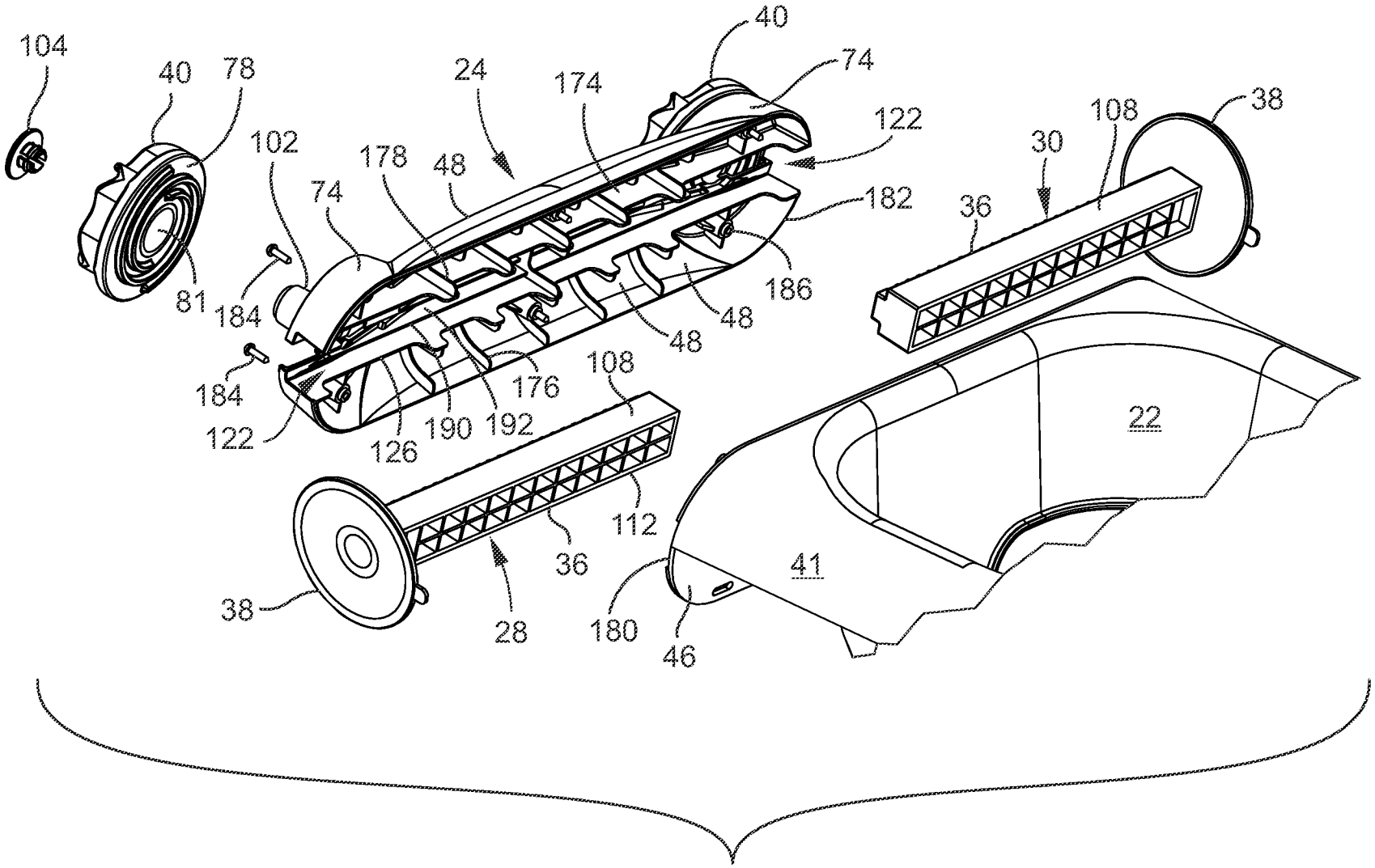
FIG. 21 is a perspective, exploded, top, rear view of the front end of the bath seat apparatus of FIG. 1.

Receptor 122 is further formed in part by a horizontally extending frame portion or platform 126 shown in FIG. 21.

Figure 26:
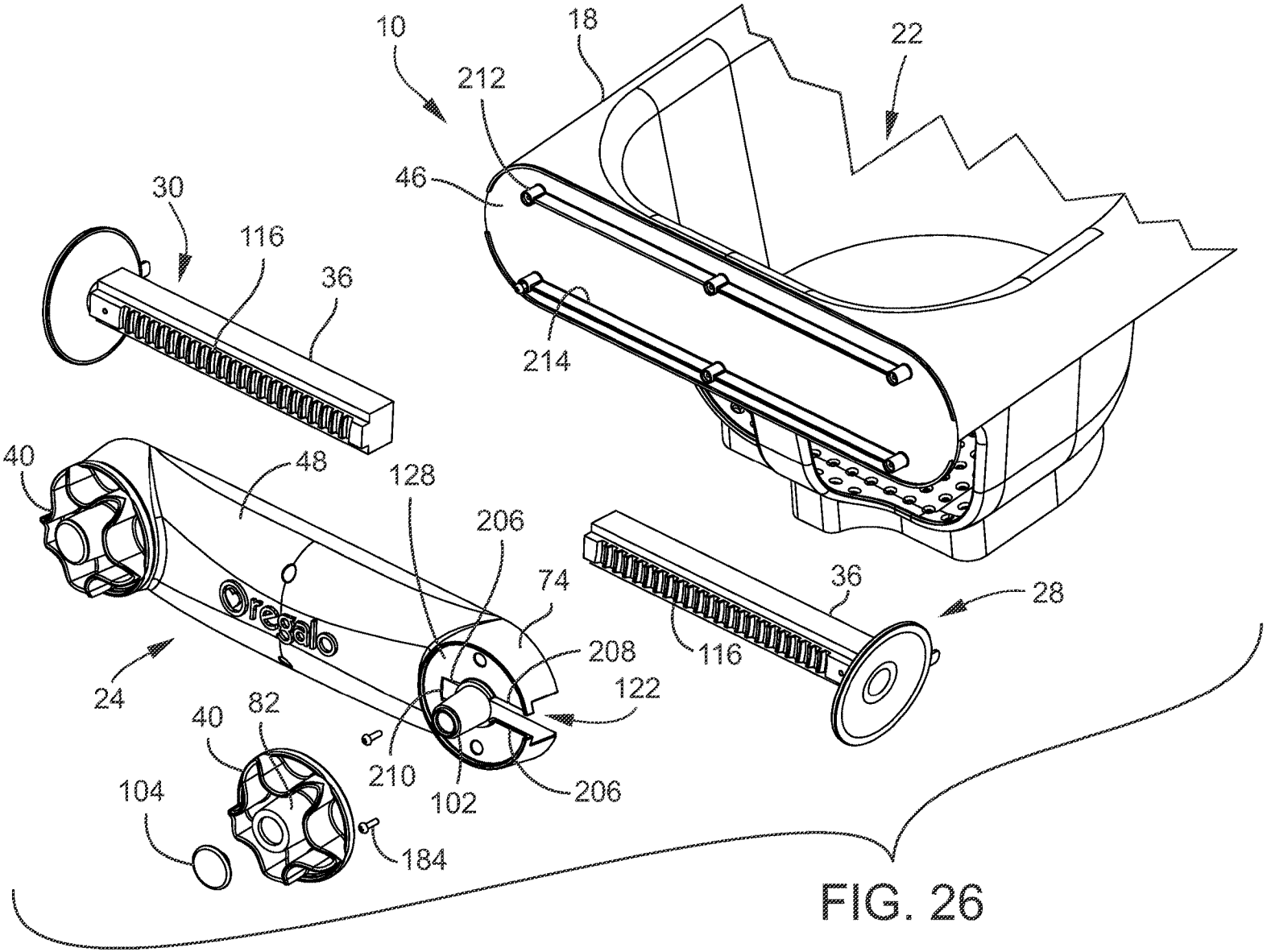
FIG. 26 is a perspective broken apart view of the front end frame portion of the bath seat apparatus of FIG. 5, where the front two rack portions are disengaged from the front end frame portion.
Figure 27:
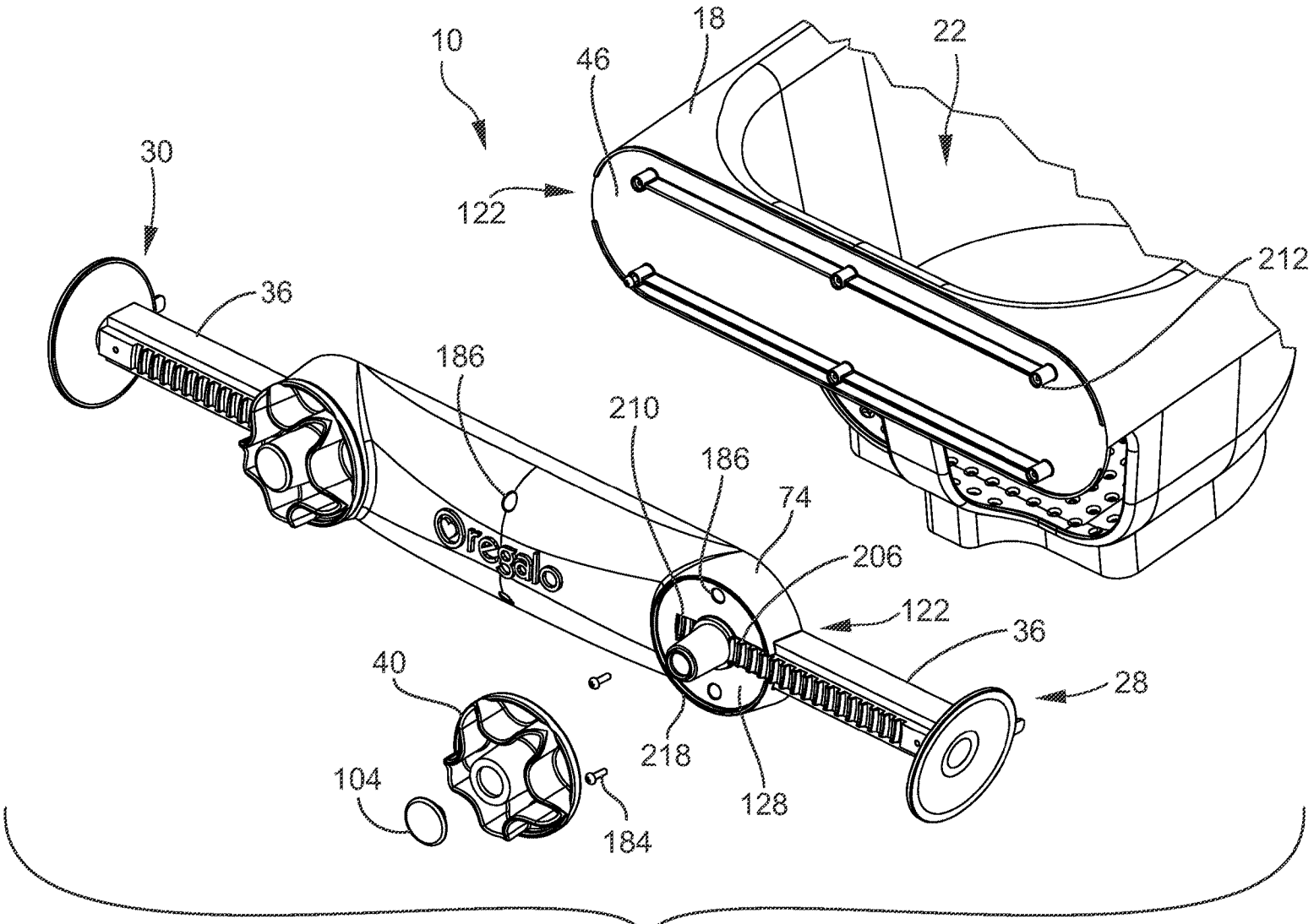
FIG. 27 is a perspective broken apart view of the front end frame portion of the bath seat apparatus of FIG. 5, where the front two rack portions are engaged with the front end frame portion of the bath seat apparatus.
Figure 28:
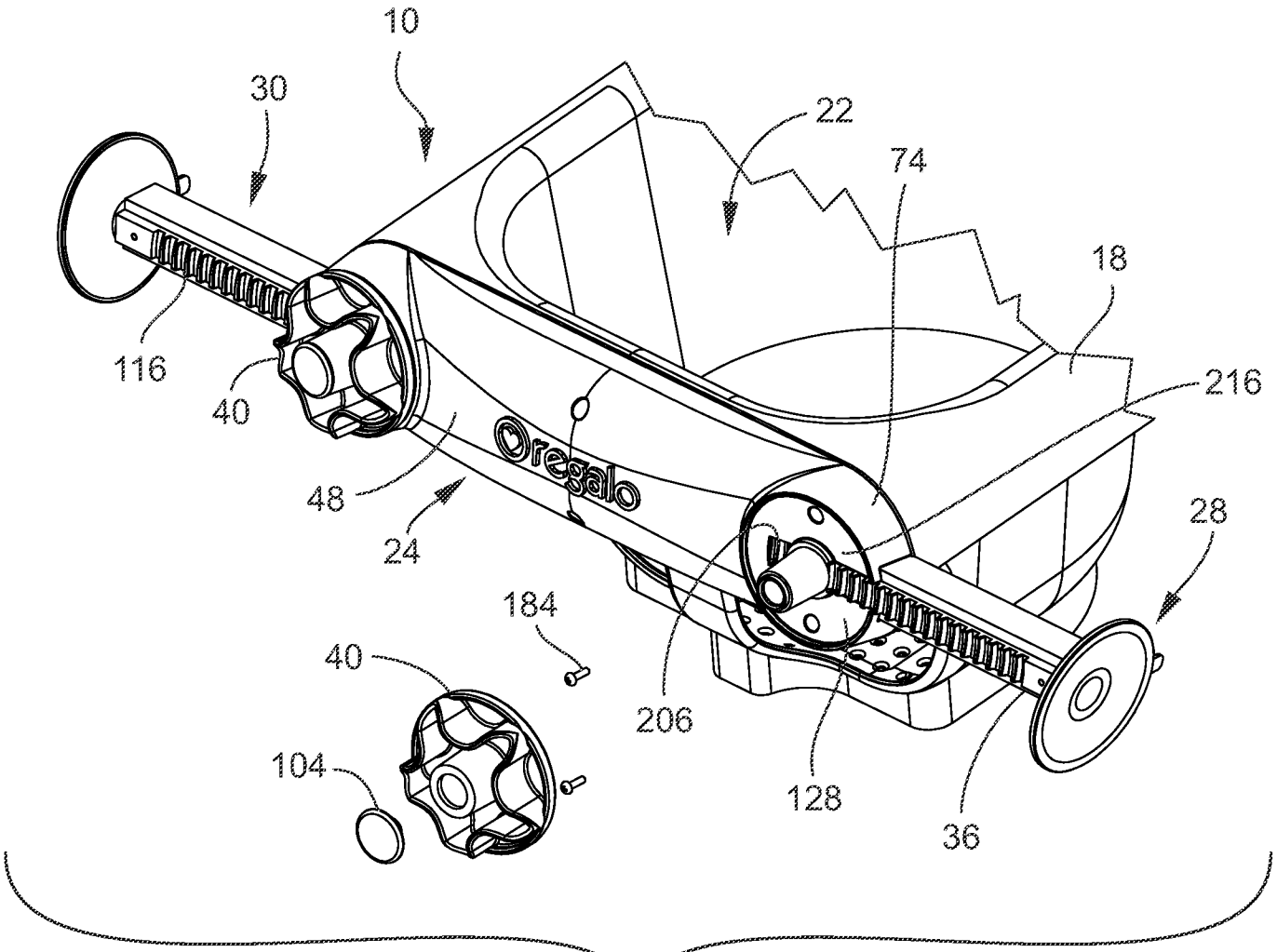
FIG. 28 is a perspective broken apparat view of the front end frame portion of the bath seat apparatus of FIG. 5, where the front two rack portions are engaged with the front end frame portion of the bath seat apparatus, and where the front end frame portion is engaged to the frame of the bath seat apparatus, and where one pinion is disengaged from the front end portion.

As shown in FIG. 15, only a portion of each of the pinion teeth 86, 88 engage the teeth 116 of the rack portion 36. Such portion of the pinion teeth 86, 88 continually changes as the pinion 40 is being rotated. When pinion teeth 86, 88 are not engaging rack teeth 116, pinion teeth 86, 88 ride on a disk like platform 128, a portion of which is shown in FIG. 15, and front views of which are shown in FIGS. 26, 27, and 28. Disk like platform 128 is found in the interior of partially cylindrical frame portions 74 and has a slot 206 formed therein for receiving the straight row of rack teeth 116.

FIG. 15 shows that the base 78 and its under face 90 are obliquely disposed relative to the axis on which the rack portion 36 slides. FIG. 15 shows that the rotation axis of the pinion 40, defined by a central axis of the frustoconcial portions 82, 102, is oblique to the axial axis of the rack portion 36. FIG. 15 shows that, when a portion of each of the spiral teeth 86, 88 engages the rack portion 36, another portion of each of the spiral teeth 86, 88 is disposed directly over the rack portion 36 in a position where such other portion of the spiral teeth 86, 88 is disengaged from the rack teeth 86, 88.

Platform 128 defines a first plane. Base 78 of pinion defines a second plane. These first and second planes are oblique to the axis of its respective adjacent arm 28, 30, 32, 34.

Pinion 40 includes an axis about which the pinon 40 rotates. This axis of rotation lies obliquely to the axis of its respective adjacent arm 28, 30, 32, 34.

Figure 18A:
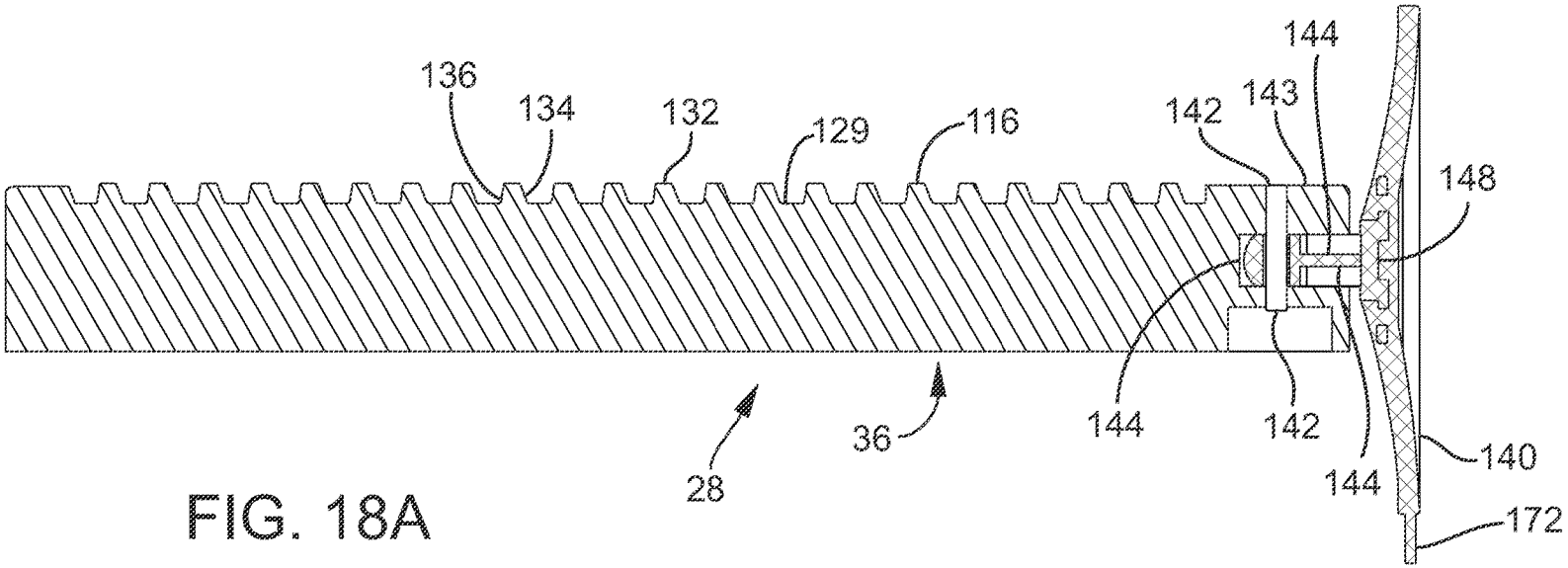
FIG. 18A is a section view at lines 18A-18A of FIG. 18B.
Figure 18B:
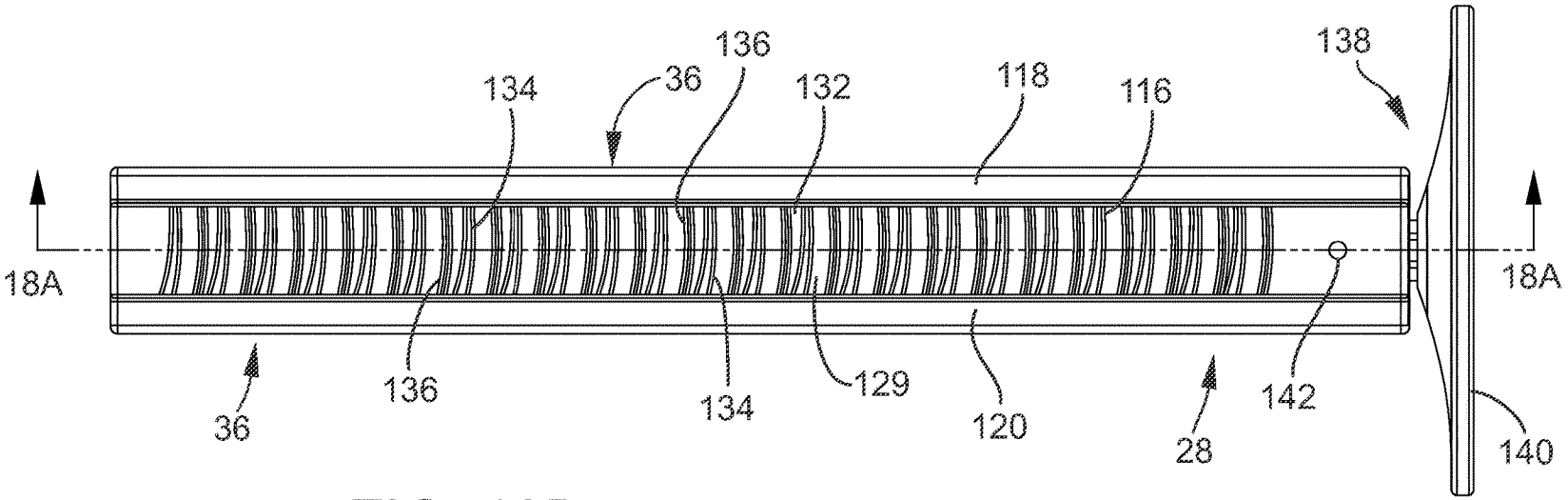
FIG. 18B is an isolated end view of a portion of the arm assembly of FIG. 15.

As shown in FIG. 18B, rack teeth 116 run obliquely to the axis of the rack portion 36. Rack portion 36 includes a space 129 between adjoining rack teeth 116. This space 129 is what the top 130 of pinion teeth 86, 88 confronts. This space 129 is arcuate or curved as it runs in the direction from elongate face 118 to elongate face 120 or from one tooth end 116 to the other end of the same tooth 116. Each of the rack teeth 116 includes a rack tooth top 132. This rack tooth top 132 is arcuate or curved as it runs in the direction from elongate face 118 to elongate face 120. Each of the rack teeth 116 includes a rack tooth outer side 134. This rack tooth outer side 134 is arcuate or curved as it runs in the direction from elongate face 118 to elongate face 120. Each of the rack teeth 116 includes a rack tooth inner side 136. This rack tooth inner side 136 is arcuate or curved as it runs in the direction from elongate face 118 to elongate face 120. Such curving or arcuate structures of the rack teeth 116 match the spiral curvature of the pinion spiral teeth 86, 88.

It should be noted that the pinions 40 operate as a lock against the rack portions 36 sliding axially in and out of the frame 18. In other words, pushing or pulling on the arms 28, 30, 32, 34 does not rotate the pinions 40. Rack teeth 116, while arcuate from end to end, have a tangential relationship to the axial axis of the rack teeth 116 that does not deviate far from a right angle relationship with the axial axis. In fact, a tangent to one point on the arcuate teeth may be at a right angle or substantially at a right angle to the axial axis. At the same time the spiral teeth 86, 88 define gently curving spirals. One way to understand how the pinion 40 operates as a lock is the following hypothetical: 1) let us presume that the rack teeth 116 define a straight line perfectly set at a right angle to the axial axis of the rack portion 36; 2) then when pushing in on the rack portion 36 against the spiral teeth 86, 88 that have an axis intersecting the axis of the rack portion 36 would be pushing straight right angled rack teeth 116 against a substantially circular structure, which would result in equal forces pushing the circular structure to rotate both ways at the same time, with the result being no rotation at all. Thus, in practice, with the present pinion and rack portion 36, rack portion 36 does not slide by a manual hand pulling or manual hand pushing upon the rack portion 36 or any portion of the arms 28, 30, 32, 34. In practice, rotating the pinion 40 is the only force or operation that drives a sliding of the arms 28, 30, 32, 34 in and out relative to the frame 18.

As shown in FIGS. 18A, 18B, 19A, and 19B, each of the arms 28, 30, 32, 34 includes a suction cup assembly 138. Suction cup assembly 138 includes a suction cup 140 formed of a material having one or more of resilient, elastomeric, or rubber like qualities such that the suction cup 140 adheres or sticks to a singular location on the inner side 14 of the bath tub 12. Suction cup 140 is pivotable on a horizontal axis that extends at a right angle to the axis of the rack portion 36. This horizontal axis is provided by a horizontal pin 142. Pin 142 is engaged by an outer end 143 of rack portion 36 and is further engaged by a base 144 pivotally engaged to or pivotally set in an outwardly opening cavity 145 formed in the outer end 143 of the rack portion 36. Base 144 extends out of the outwardly opening cavity 145 to extend out of the outer end 143 of the rack portion 36. Base 144 further extends into a rear central portion of the suction cup 140 where a distal end 148 of the base 144 is fixed. The distal end 148 of the base 144 extends integrally in a radial direction to minimize the suction cup 140 and the base 144 from being disengaged from each other. The width or diameter of the suction cup 140 is greater than a height of the end 143 of the rack portion 36. The amount of pivoting provided by base 144 is restricted by the outwardly opening cavity 145 to preferably less than a degree arc, still more preferably less than a 20 degree arc, and most preferably about a ten degree arc. With such an assembly, suction cup 140 pivots up and down. With such an assembly, suction cup 140 is restricted from pivoting right and left. However, if desired, a suction cup assembly can be provided that provides a ball joint type of motion where pivoting of the suction cup 140 can occur up and down such as on a horizontal axis, right and left such as on a vertical axis, and obliquely such as on an axis positioned obliquely.

FIG. 1 shows that the bath seat apparatus 10 can be set relatively deeply in an adult sized bath tub 12. Suction cups 30 are spaced from a top of the bath tub 12 and are spaced from the inner bottom 16 of the bath tub 12. FIG. 1 further shows that bath seat apparatus 10 is spaced from both ends of the bath tub 12. However, since the arms 28, 30, 32, 34 are independently extendable and independently retractable, the bath seat apparatus 10 can be set relatively close to the end of the bath tub 12 where opposing inner sides 14 of the bath tub 12 start to curve or taper toward each other such that arms 28, 30 can extend to a first distance apart from each other as measured by the distance between their respective suction caps 30 and such that arms 32, 34 can extend to a second distance apart from each other as measured by the distance between their respective suction caps 30. In other words, arms 28, 30 may engage straight sides of the bath tub 12 while, at the same time, arms 32, 34 may engage curved sides of the bath tub 12, where curved sides of the bath tub 12 are closer to each other than are straight sides of the bath tub 12, where the arms engaging the curved sides of the bath tub 12 may have a ball joint type of engagement with their respective suction cups 140.

FIG. 2 also shows that, if desired, the bath seat apparatus 10 may be set closer to either of the ends of the bath tub 12. Also, as indicated above, the bath seat apparatus 10 may have arm pair 28, 30 or arm pair 32, 34 engaging an end of the bath tub 12 having curved sides. FIG. 3 also shows that the bath seat apparatus 10 can be set relatively deeply in an adult sized bath tub 12. Suction cups 30 may be spaced from a top of the bath tub 12 and may be spaced from the inner bottom 16 of the bath tub 12. FIG. 3 further shows that the bottommost edge 64 of the bottom 62 or bottom wall 62 may rest on the bottom 16 of the bath tub 12. FIG. 3 further shows the up and down pivoting of the suction cup assembly 138, the suction cup 140 of which is pivoted downwardly to grab the oblique side 14 of the bath tub 12, which oblique side 14 extends inwardly and downwardly. It is to be noted that, if desired, bath seat apparatus 10 can be engaged to bath tub 12 such that bottommost edge 64 is spaced from bath tub bottom 16 such that bath seat apparatus 10 may be suspended in the bath tub 10 by the engagement of arms 28, 30, 32, 34 with the inner sides 14 of the bath tub 12.

FIG. 4 shows that leg opening 54, and thus also leg opening 56, are adjacent to the inside bottom 16 of the bath tub 12. Hence the feet of the child may rest upon or be disposed adjacent to the inside bottom 16 of the bath tub 12. This is in contrast to the feet of the child being suspended in the water.

FIG. 5 shows the bath seat apparatus 10 having arms 28, 30, 32, 34 extended. Here the distal ends 143 of the rack portions 36 are spaced apart from their respective pinions 40.

Figure 6:
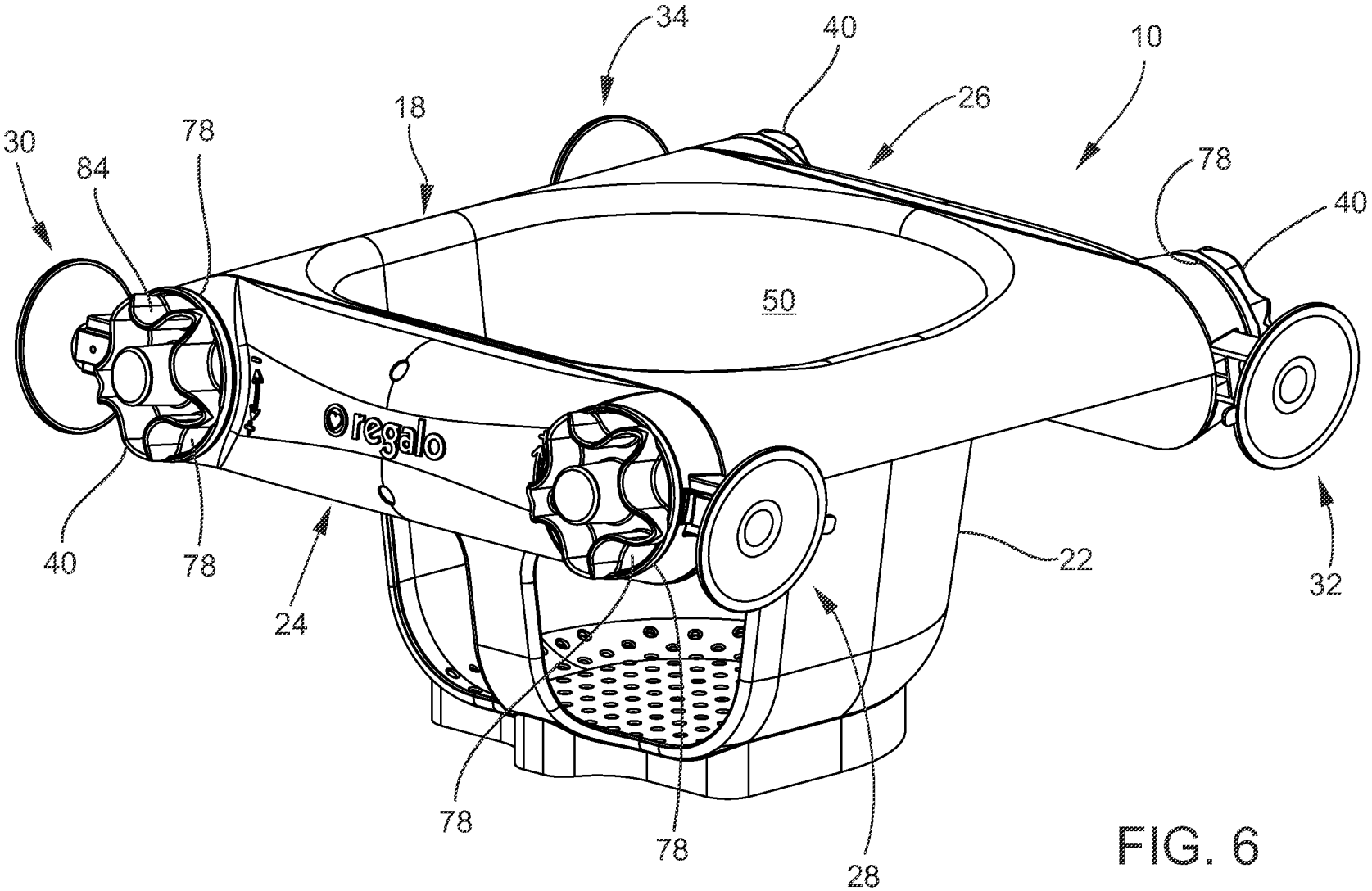
Figure 7:
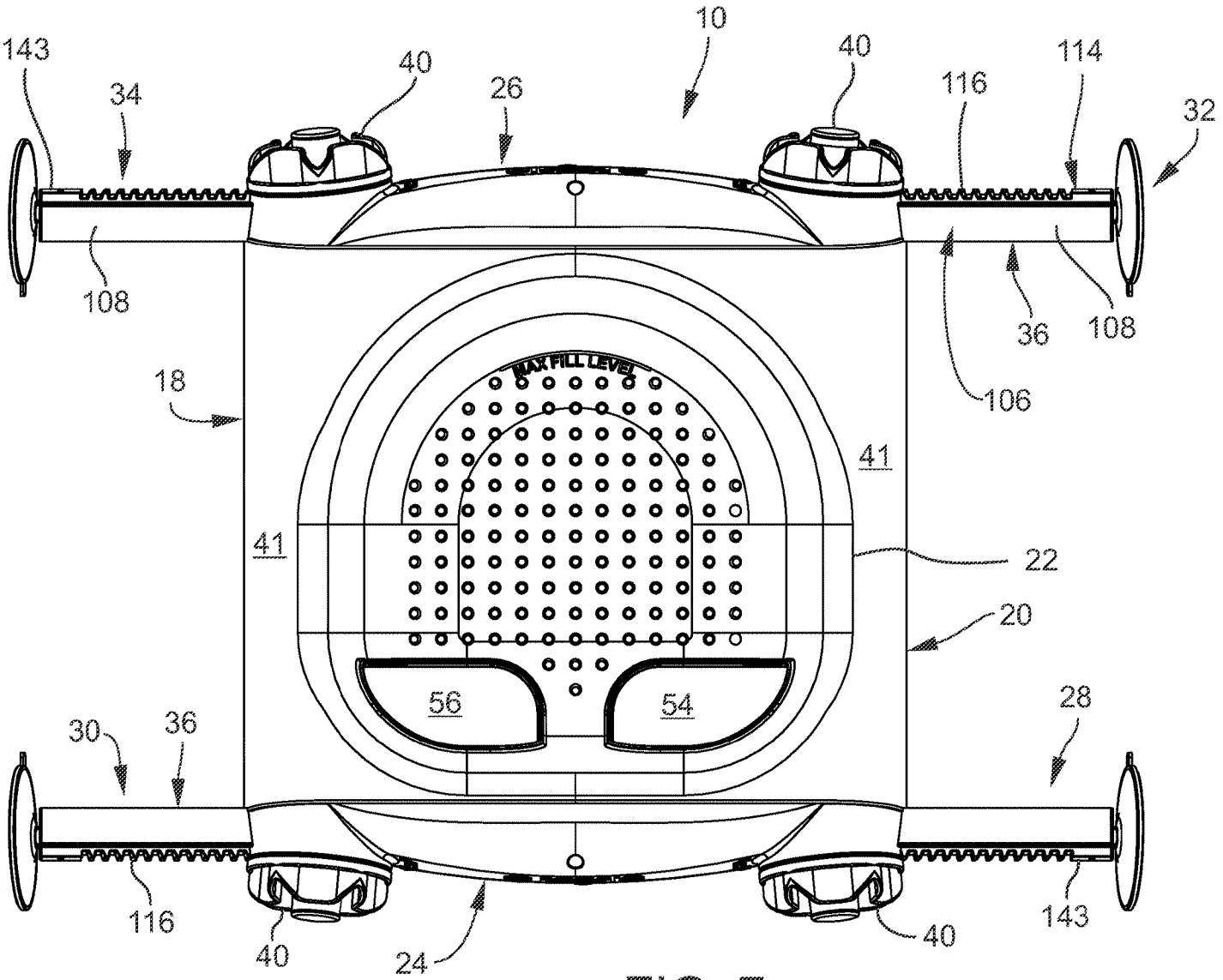
FIG. 7 is a top detail view of the bath seat apparatus of FIG. 5, where arms of the bath seat apparatus have been drawn out.

FIG. 6 shows the bath seat apparatus 10 having arms 28, 30, 32, 34 retracted. Here the distal ends 143 of the rack portions 36 are adjacent to or confront the pinions 40. FIG. 7 shows that the axis of each of the pinions 40 is disposed obliquely relative to the axis of its respective rack portion 36. This obliqueness provides that only a portion of the teeth 86, 88 engage the rack portion at one time. FIG. 7 also shows that the axis of the front pinions 40 are disposed obliquely relative to each other. FIG. 7 also shows that the axis of the rear pinions 40 are disposed obliquely relative to each other. FIG. 7 shows the arms 28, 30, 32, 34 in an extended position where the distal ends 143 of the rack portions 36 are spaced apart from their respective pinions 40. FIG. 7 shows that the teeth 116 of the rack portion 36 stop at the distal end 143, which may be defined as the section of the rack portion 36 that has no teeth 116. This distal end 143 includes the outwardly extending cavity 145 that houses the base 144 of the suction cup assembly 138. FIG. 7 further shows that arms 28 and 30 includes first and second respective straight axis and that such straight axis are coaxial. FIG. 7 further shows that the arms 32, 34 includes third and fourth respective straight axis and that such straight axis are coaxial.

Figure 8:
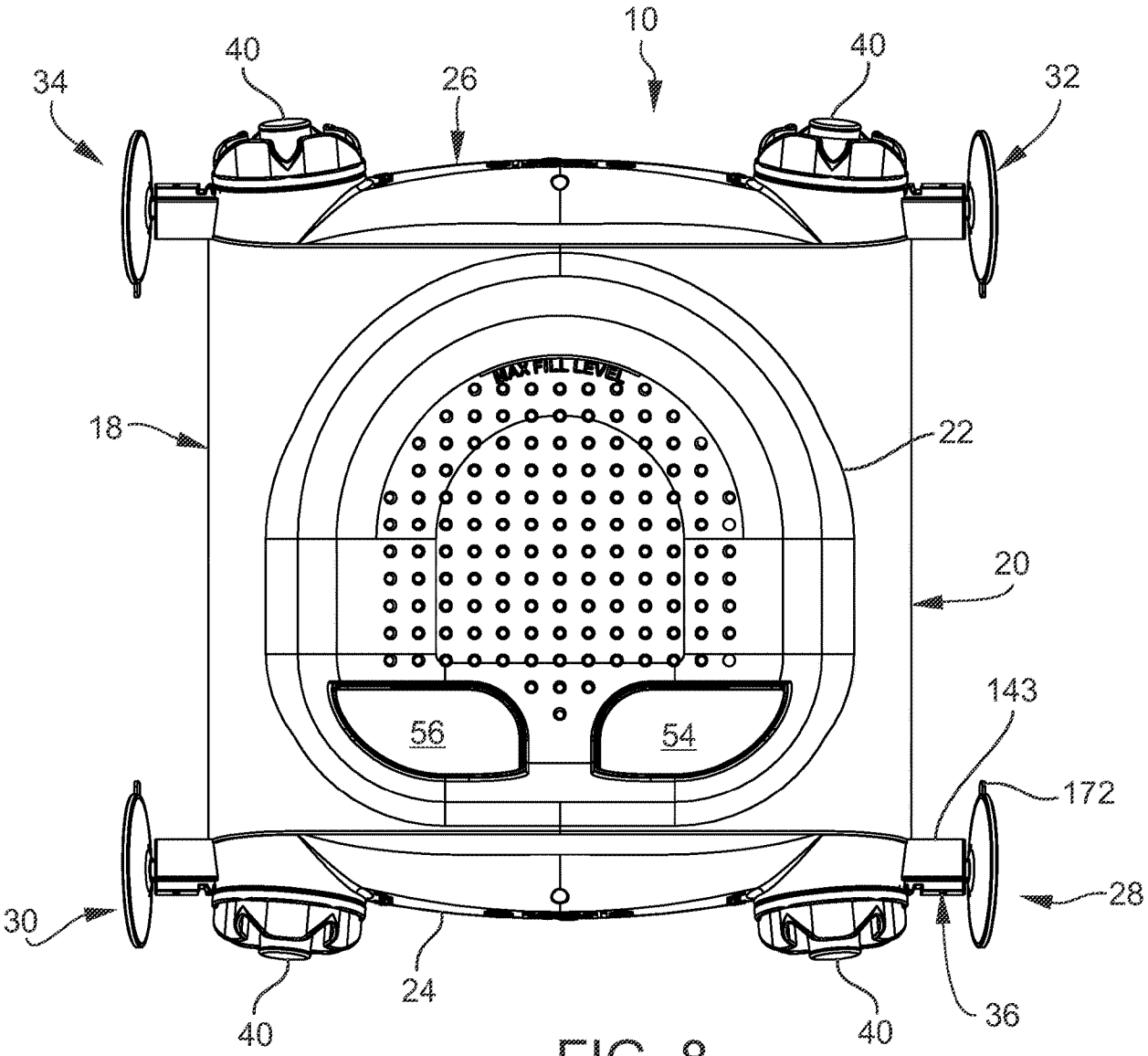
Figure 9:
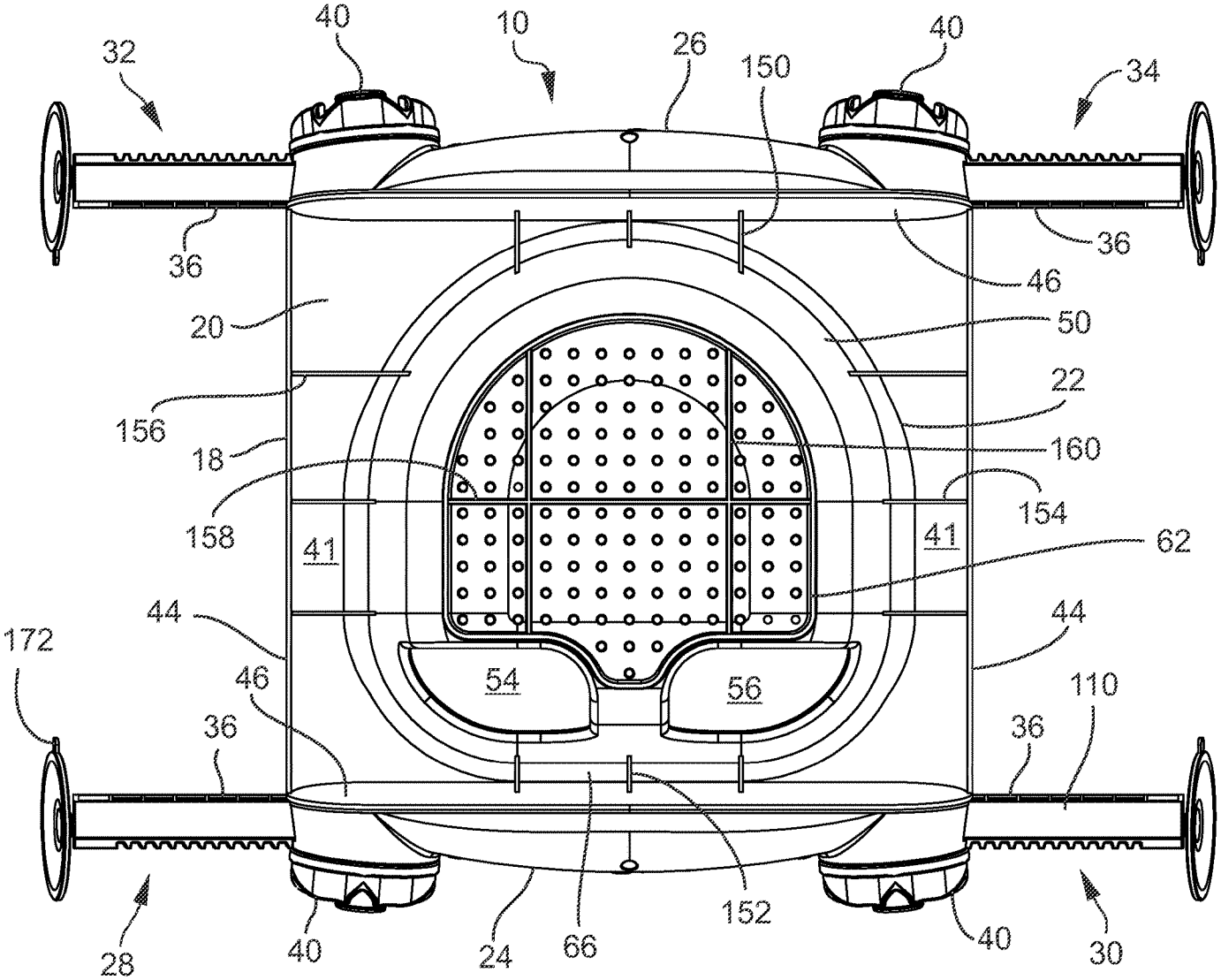
FIG. 9 is a bottom detail view of the bath seat apparatus of FIG. 5, where arms of the bath seat apparatus have been drawn out.

FIG. 8 shows the retracted positions of the arms 28, 30, 32, 34 where the distal ends 143 of the rack portions 36 are adjacent to or confront their respective pinions 40. Arms 28, 30, 32, 34 are retractable until pinion teeth 86, 88 no longer have rack teeth 116 to engage. In other words, teeth 86, 88 draw in rack portion 36 until the outward most rack tooth 116 is engaged, whereupon such retraction stops. FIG. 9 shows a bottom view of the bath seat apparatus 10. FIG. 9 shows a set of three ribs 150 extending from the outside rear of the sidewall portion 50 to inner plate section 46 of frame rear end 26. Ribs 150 extend vertically and engage the sidewall 50, the underside of the base 20, and the inner plate section 46 of frame rear end 26. FIG. 9 further shows a set of three ribs 152 extending from the T-shaped portion 66 of the sidewall of the child receptacle 22 to inner plate section 46 of frame front end 24. Ribs 152 extend vertically and engage the front T-shaped portion 66 of the child receptacle sidewall 50, the underside of the base 20 including annular edge 43, and the inner plate section 46 of frame front end 24. FIG. 9 further shows a first set of three vertically extending ribs 154 extending from U-shaped sidewall portion 50 to the underside of base and further to edge 44. FIG. 9 further shows a second set of three vertically extending ribs 156 extending from U-shaped sidewall portion 50 to the underside of base 20 and further to edge 44. Ribs 154 are on one side of the receptacle 22 and ribs 156 are on the opposite side of the receptacle 22 than ribs 154. Ribs 150, 152 extend longitudinally. Ribs 154, 156 extend laterally. FIG. 9 further shows a lateral rib 158 engaging the bottom of seat 52 and further engaging opposite sides of bottom 62 or bottom wall 62. FIG. 9 further shows a pair of longitudinal ribs 160 engaging the bottom of seat 52 and further engaging opposite sides of bottom 62 or bottom wall 62. Rib 158 engages ribs 160. Ribs 158, 160 have bottom edges that define a common plane, and bottommost edge 64 also defines this common plane. Where it is desirable that bath seat apparatus 10 rests on the inner bottom 16 of bath tub 12, bottommost edge 64 and the bottommost edges of ribs 158, 160 provide a stable platform. Arms 28, 30, 32, 34 are in an extended position in FIG. 9.

Figure 10:
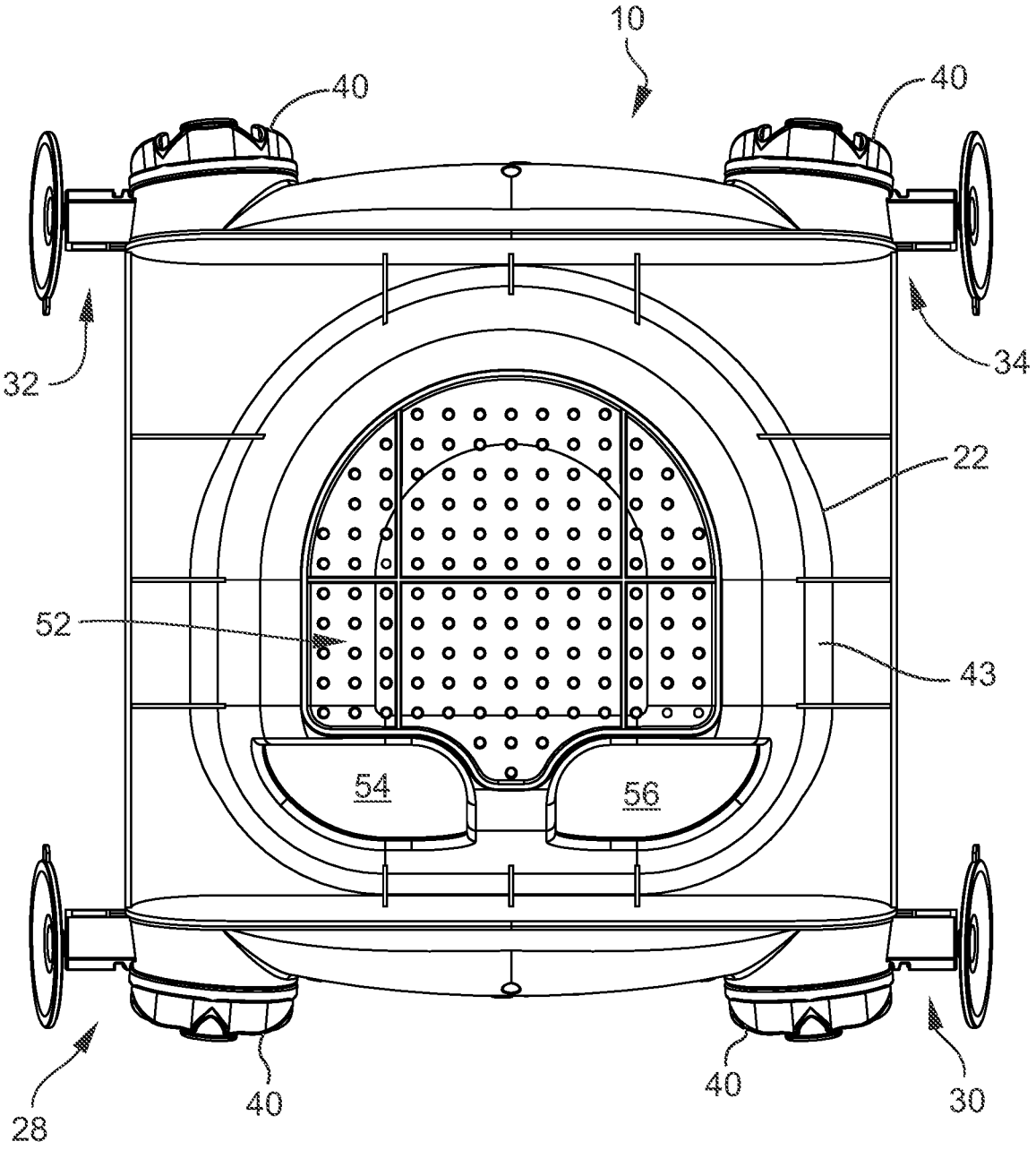

FIG. 10 shows a bottom view of the bath seat apparatus 10 with the arms 28, 30, 32, 34 in a retracted position, where the retracted position is the same retracted position shown in the top view of the bath seat apparatus 10 of FIG. 8.

FIG. 11 is a front view of the bath seat apparatus 10 and shows that arms 28, 30, 32, 34 define a plane as arms 32, 34 are hidden behind arms 28, 30. FIG. 11 further shows pinion retaining cap 104, pinion outer frustoconical portion 82, pinion undulating wall 84, and pinion base 78. All of such features 104, 82, 84, 78 of pinion 40 rotate with one another at the same time and when pinion 40 rotates, and the threads or teeth 86, 88 rotate as such features rotate and as such pinion 40 rotates. FIG. 11 further shows plus and minus markings 162 that show rotation of pinion 40 for arm 28 in the clockwise direction extends the arm 28 and that rotation in the counter-clockwise direction retracts the arm 28. FIG. 11 further shows plus and minus markings 164 that show rotation of pinion 40 for arm 30 in the clockwise direction extends the arm 30 and that rotation in the counter-clockwise direction retracts the arm 30. Pinion 40 is a hand control that is rotatable for driving the arms 28, 30, 32, 34 back and forth. The undulating wall 84 provides surfaces for the fingers and thumb to easily rotate the pinion 40 with the hand.

Figure 12:
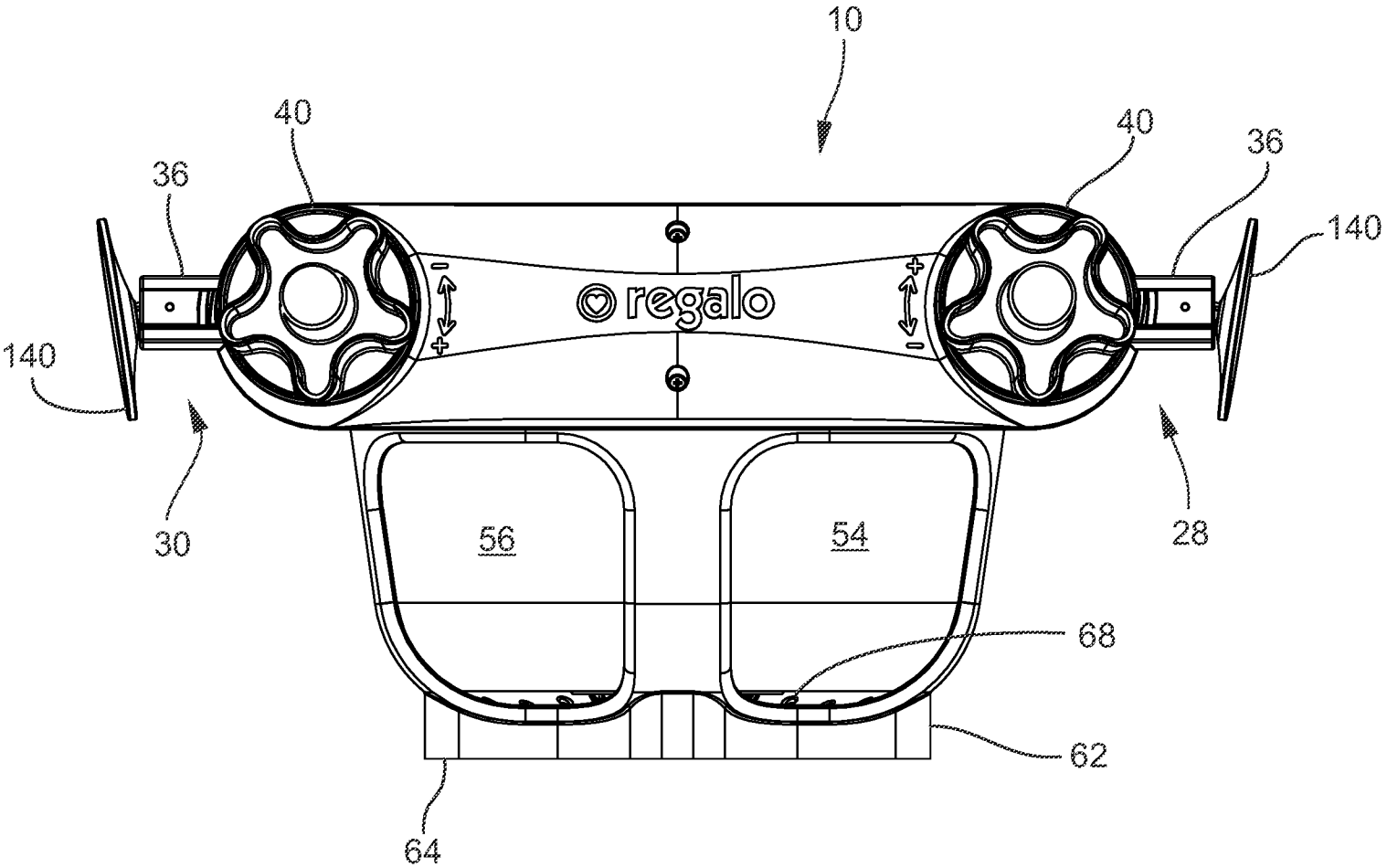

FIG. 12 shows the same view as FIG. 11 except that the arms 28, 30 are in a retracted position. FIGS. 11 and 12 further show that the perforations 68 formed in the child receptacle 22 are formed in portions of the seat 52 that are disposed below uppermost portions of bottom wall 62. Uppermost portions of bottom wall 62 define a plane and further define a preferred water line for bath water in the bath tub 12 such that arms 28, 30, 32, 34 and their respective suction cups 140 operate above a preferred water line for bath water in the bath tub 12. However, bath seat apparatus 10, pinons 40, rack portions 36, rack teeth 116, pinion teeth 86, 88, and suction cups 140 may operate submerged in water, may operate out of water when dry, and may operate out of water when wet.

Figure 13:
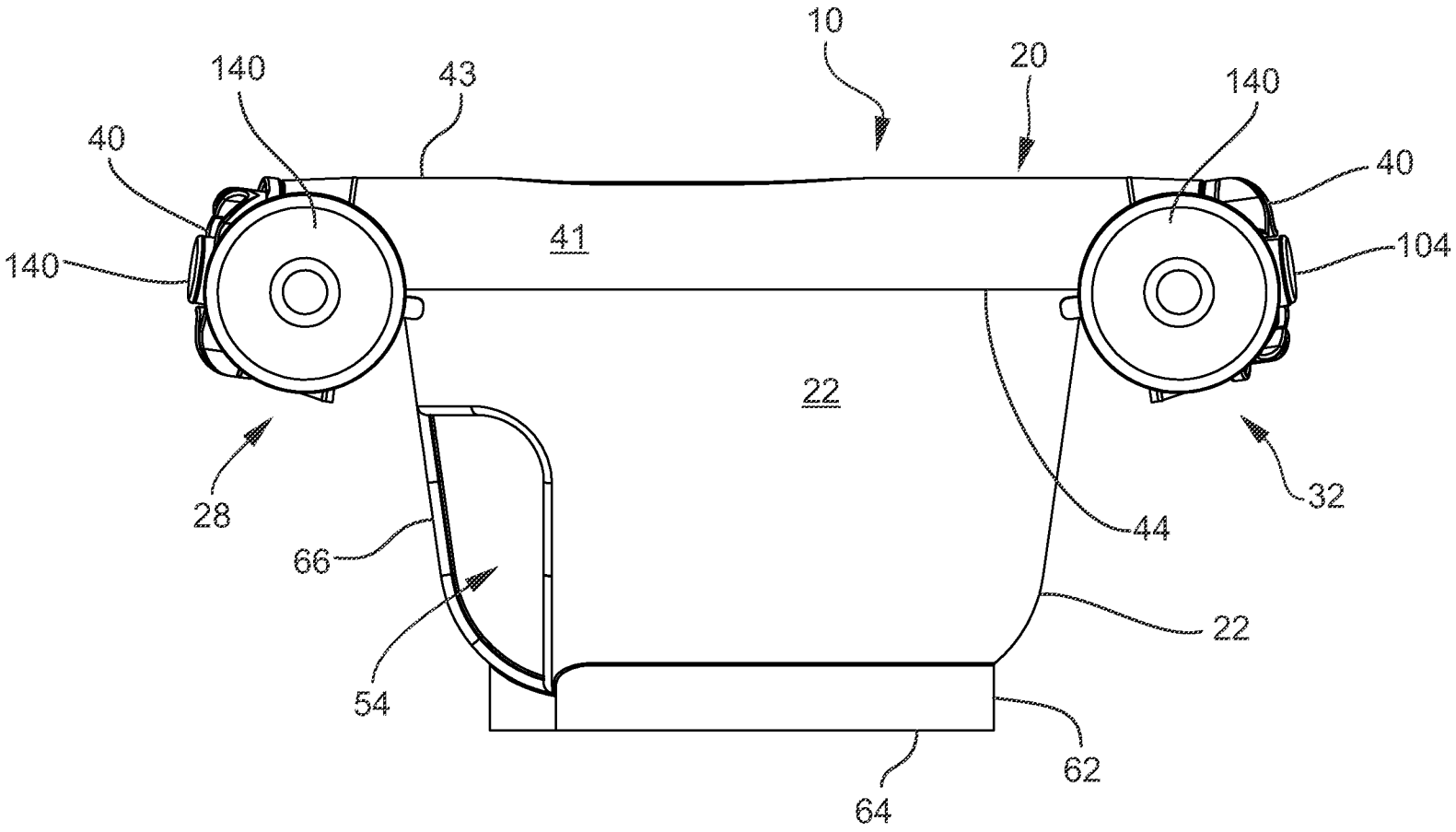
FIG. 13 is a side detail view of the bath seat apparatus of FIG. 5.
Figure 14:
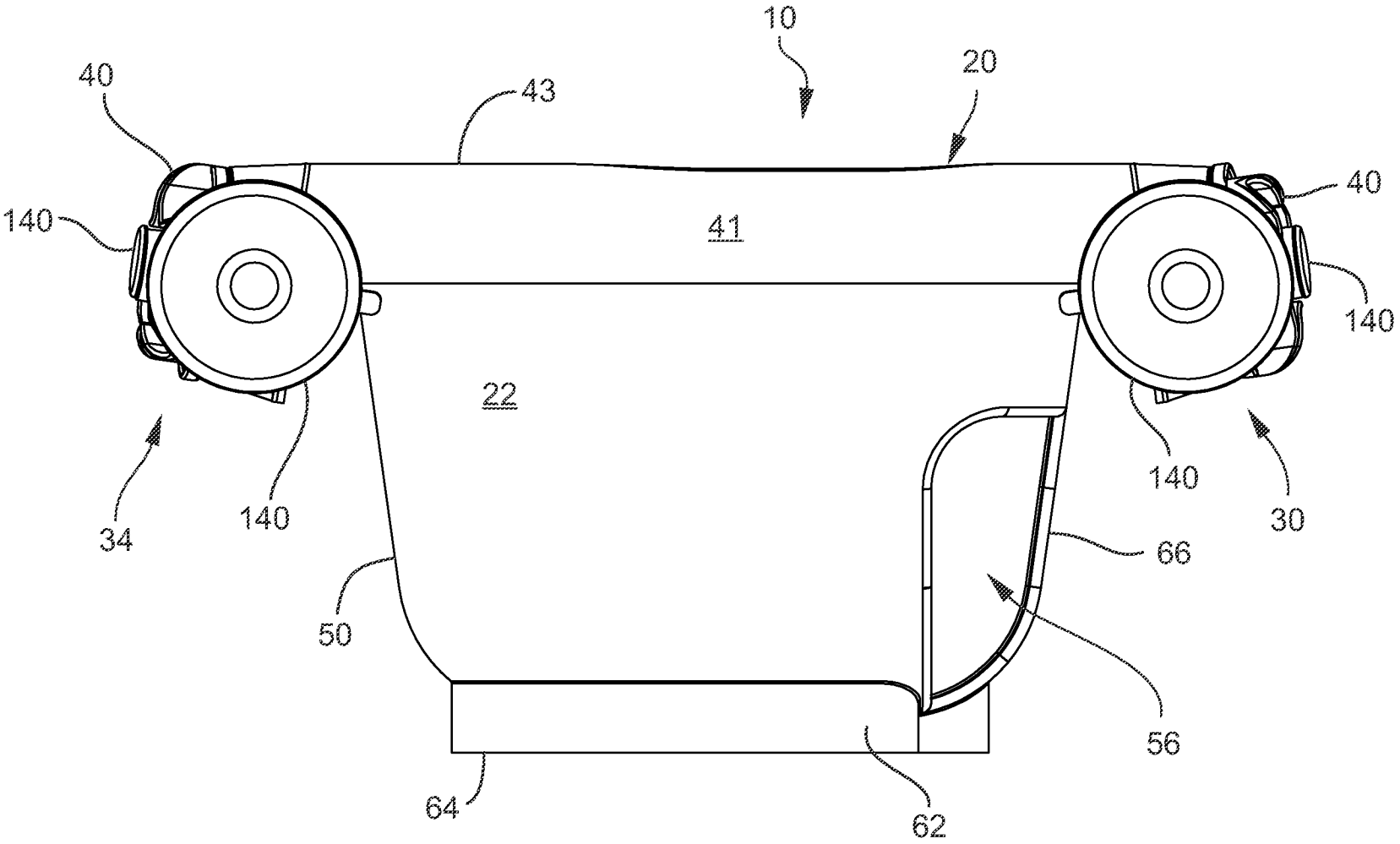
FIG. 14 is a side detail view of the bath seat apparatus of FIG. 5, showing the side opposite of FIG. 13.

FIG. 13 is a side view of the bath seat apparatus 10 and FIG. 14 is a side view of the side opposite of that shown in FIG. 13. FIGS. 13, 14 show that the leg openings 56 are disposed entirely above the bottommost edge 64 of the seat bottom 62, that the seat bottom 62 is disposed between the suction cups 140, that the rearward-most portion of the U-shaped portion 50 of the sidewall of the receptacle 22 extends downwardly and inwardly to the seat bottom 62, that the uppermost portions of the suction cups 140 are disposed above the uppermost portion of the frame portion 20, and that the axis of the pinions 40 are disposed obliquely to a plane defined by the rack portions 36 of the arms 28 and 32 (in FIG. 13) and obliquely to a plane defined by the rack portions 36 of the arms 30, 34 (in FIG. 14), where the axis of the rack portions 36 are coaxial with center points of the suction cups 140 shown in FIGS. 13 and 14.

FIG. 15 shows that the axis of the pinion 40 is defined by the axis of outer frustoconical portion 82 and axis of the inner frustoconical portion 102, which axes are coaxial. Opening 81 shares this axis. The shared axis of outer frustoconical portion 82, inner frustoconical portion 102, and opening 81 is oblique to the axial axis of rack portion 36. FIG. 15 shows that rack teeth 116 are disposed obliquely, and not at a right angle, to a vertical plane having therein the axis of the rack portion 36. FIG. 15 further shows that rack portion 36 may include ribs 166 and cavities 168, where the cavities 168 open inwardly and away from the rack teeth 116.

Figure 16:
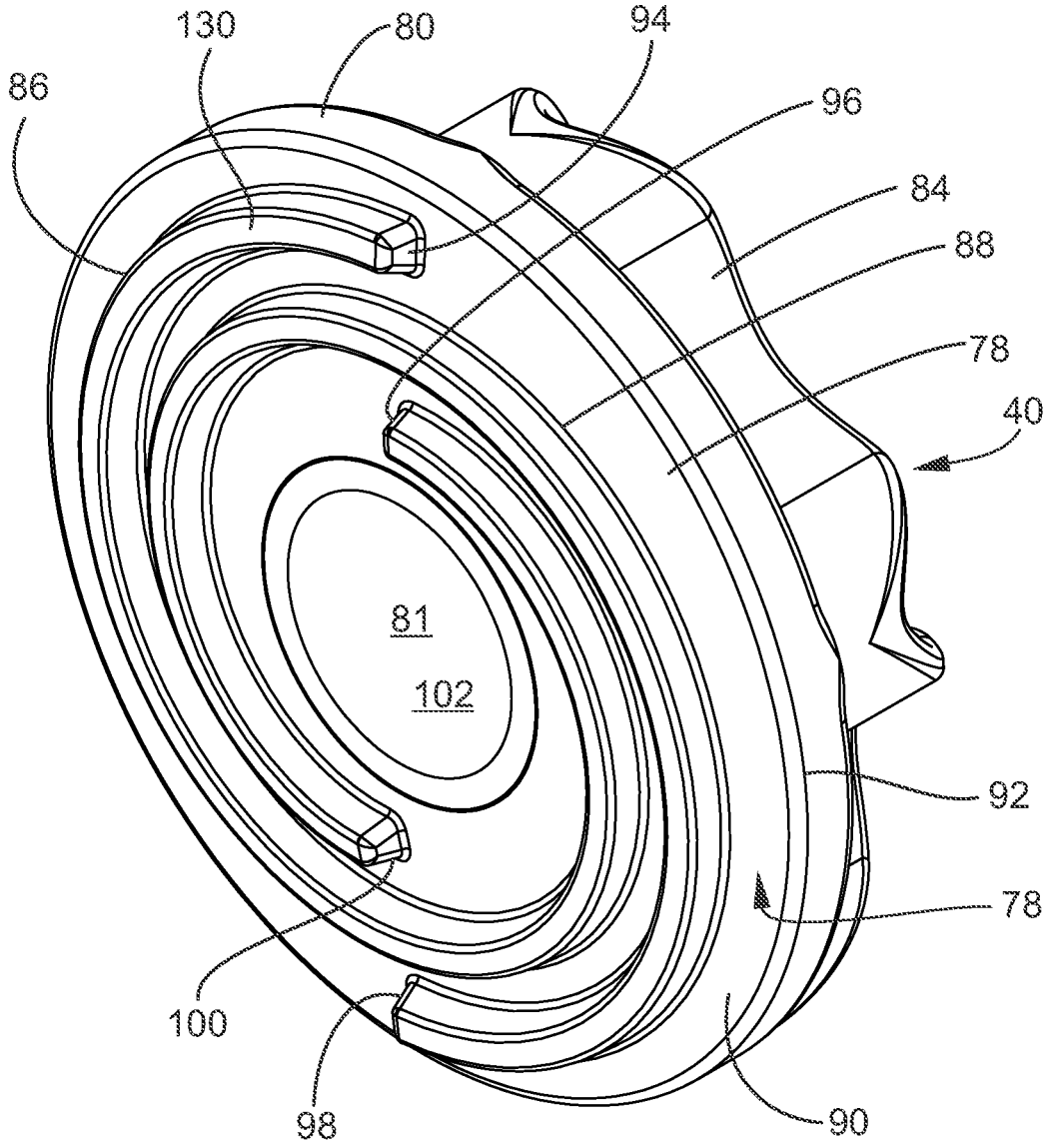
FIG. 16 is an isolated perspective view of the face of the pinion of FIG. 15.
Figure 19A:
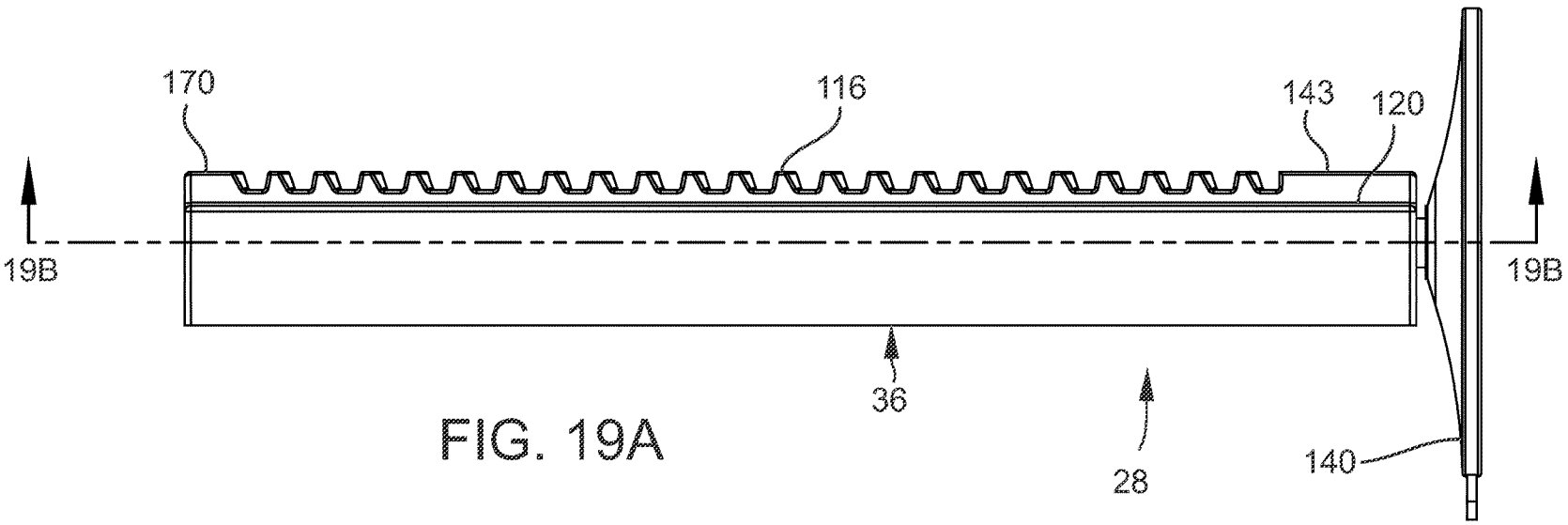
FIG. 19A is an isolated view of a portion of the arm assembly of FIG. 15.

FIGS. 16 and 17 show that the top faces or outer faces of the elongate spiral teeth 86, 88 have a lesser width than the bottoms of the elongate spiral teeth 86, 88, where the bottoms of the elongate spiral teeth 86, 88 are defined by the portions of the elongate spiral teeth 86, 88 that engage the face 90 of the pinion base 78. FIGS. 16 and 17 show that each of the elongate spiral teeth 86, 88 have an inner side that faces toward the opening 81 and an outer side that faces away from the opening 81. Each of such outer and inner sides of the elongate spiral teeth 86, 88 tapers from such top face to such bottom of such elongate spiral teeth 86, 88 where the bottom meets the face 90. FIG. 18B shows an isolated front view of arm 28 and shows an elevation view of the rack teeth 116 where rack teeth 116 curve from upper flat face 118 to lower flat face 120. FIG. 18A is a section taken at lines 18A-18A of FIG. 18B and shows that each of the rack teeth 116 tapers from where it meets the base of the rack portion 36 to the outer face or top 132. In other words, the sides of the rack teeth 116 taper so as to decrease the thickness of the tooth 116 as the tooth 116 extends away from the rack base. FIG. 19A shows an isolated bottom view of arm 28.

FIG. 19A shows the rack teeth 116 are oblique relative to an axis of the rack portion 36. The rack portion 36 slides into and out of the frame 18 along such axial axis. This axis lies in a vertical plane and the oblique teeth 116 extend obliquely relative to such vertical plane. FIG. 19A shows the distal or outer end 143 of the rack portion 36 and also shows the proximal end 170 of the rack portion 36. The rack portion 36 is straight from the proximal end 170 to the distal end 143. FIG. 19A shows that the rack teeth 116 terminate short of the vertical extending end faces of the rack portion 36.

Figure 19B:
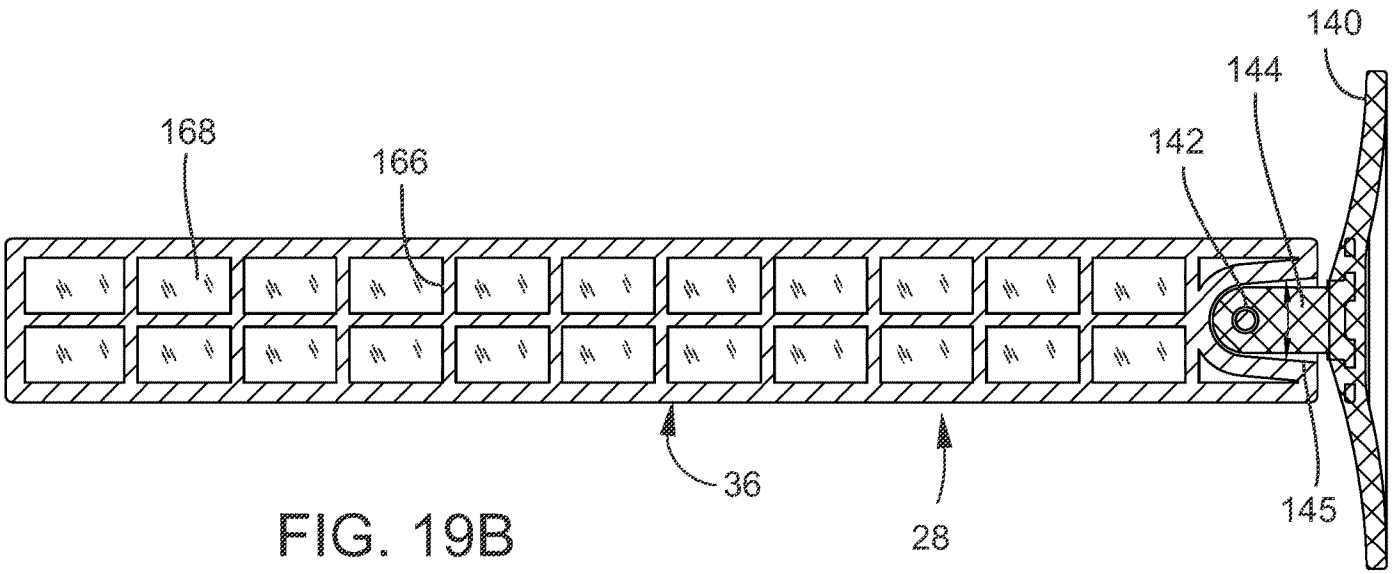
FIG. 19B is a section view at lines 19B-19B of FIG. 19A.

FIG. 19B shows the arm assembly at lines 19B-19B of FIG. 19A and shows that the ribs 166 and cavities 168 of the rack portion 36 extend from the proximal end 170 to the distal end 143. The cavities 168 open inwardly, as shown in FIG. 5. The ribs 166 extend both horizontally and vertically. FIG. 19B shows that one end of each of the cavities 168 is closed by base of the rack teeth 116 and the inner surfaces of upper and lower faces 118, 120.

Figure 20:
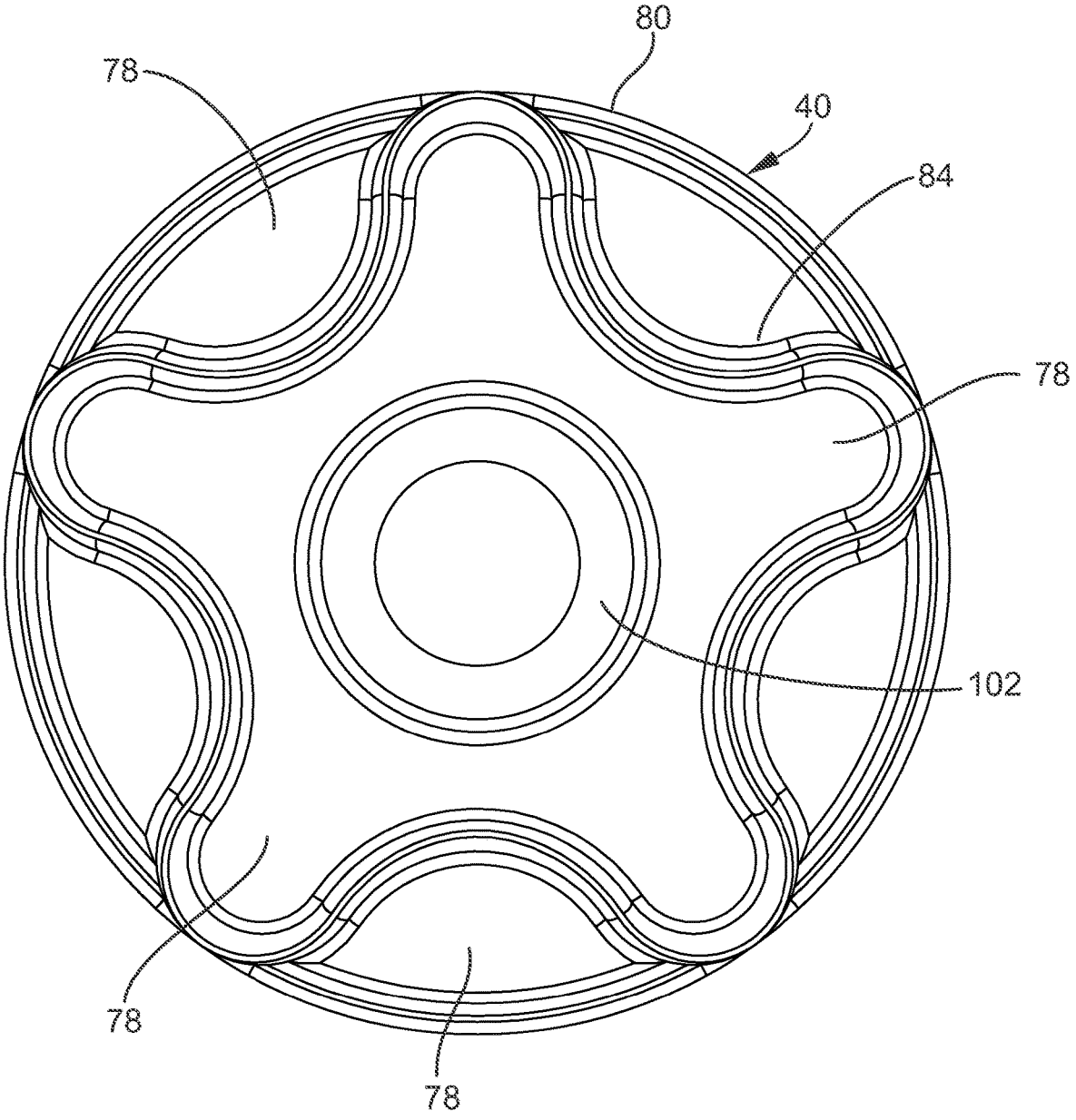
FIG. 20 is an isolated view of the outer face of the one of the pinions of the bath seat apparatus of FIG. 1.

FIG. 20 shows an isolated view of the pinion 40 without the retaining cap 104. FIG. 20 shows the pinion base 78, the outer frustoconical portion 102, the pinion undulating wall 84, and the pinion lip 80.

Figure 22:
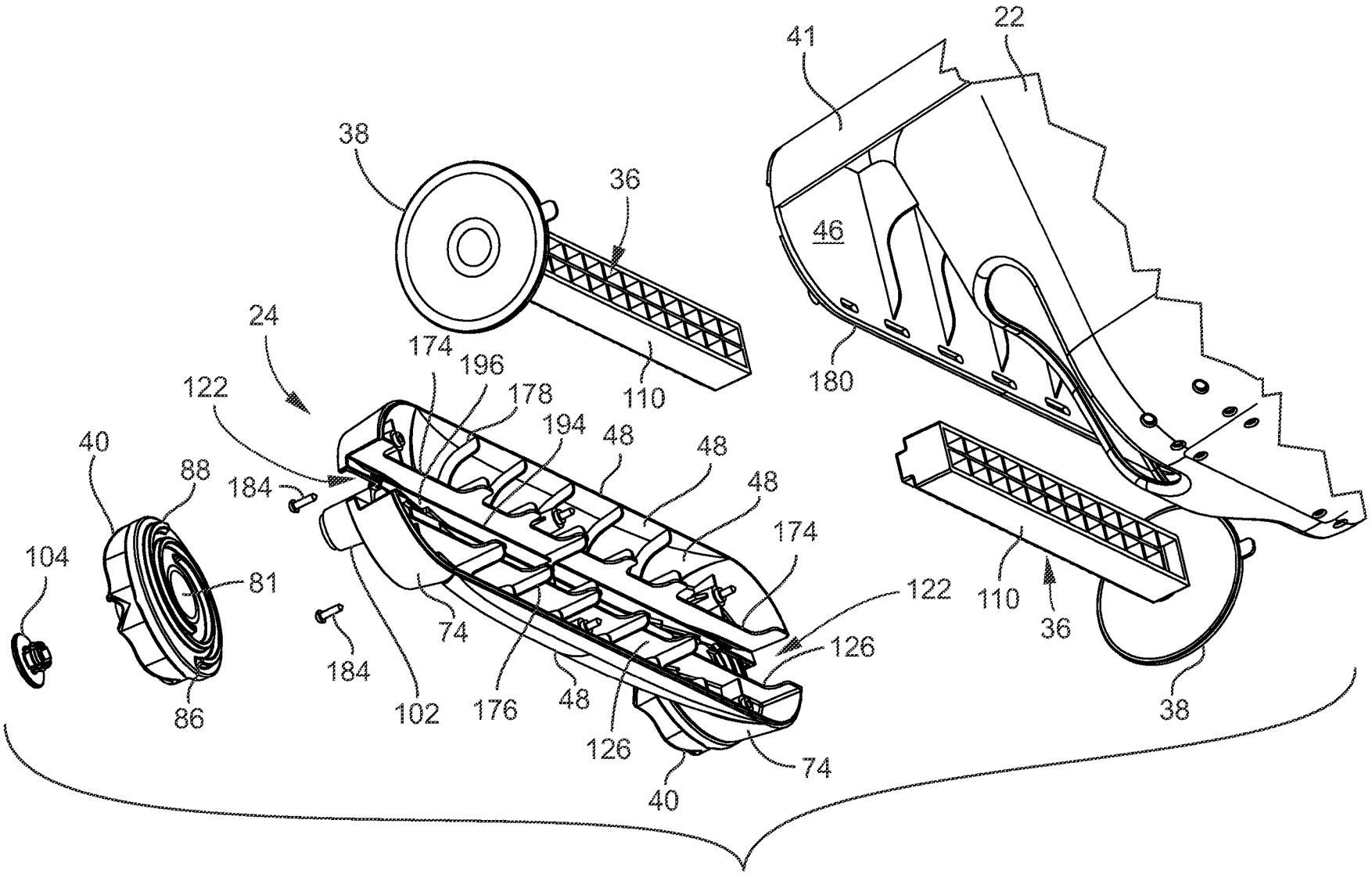
FIG. 22 is a perspective, exploded, bottom, rear view of the front end of the bath seat apparatus of FIG. 21.

FIGS. 21 and 22 show exploded views of the front end 24 of the bath seat apparatus 10 with arms 28, 30 out of the receptors 122. Receptor 122 is formed in part by the lower horizontally extending frame portion or lower plate 126. Receptor 122 is further formed in part by an upper horizontally extending frame portion or upper plate 174 that opposes the lower horizontally extending frame portion or lower plate 126. The bottom side 110 of the rack portion 36 rides on the lower plate 126. The upper side 108 of the rack portion 36 is confronted by and guided by the upper plate 174. The inner exposed rib side 112 of the rack portion 36 confronts and is guided by the inner plate section 46. The toothed side 114 of the rack portion 36 is confronted by the face 78 of the pinion 40 and further by a vertically extending frame portion 124 that is integral and one-piece with the front end 24.

Lower plate 126 is supported by a set of five integral U-shaped ribs 176 that engage the inner surface of outer plate section 48 and that further engage the lower surface of lower plate 126. Upper plate 174 is supported by a set of five integral U-shaped ribs 178 that engage the inner surface of outer plate section 48 and that further engage the upper surface of upper plate 174.

Inner plate 46 is oblong shaped so as to have an oblong periphery 180. This oblong periphery 180 confronts and engages an oblong periphery 182 of the front end frame portion 24. Oblong periphery 182 is broken by the receptors 122. Oblong periphery 180 is continuous and unbroken.

Ends of lower plate 126 are supported by and integral with partially cylindrical frame portions 74. Ends of upper plate 174 are supported by and integral with partially cylindrical frame portions 74.

A set of six pin connectors 184 are received in pockets 186 formed in the front end frame portion 24. Pockets 186 have pin openings in their rear faces through which the pin connectors 184 extend to then engage the inner plate section 46.

Figure 23A:
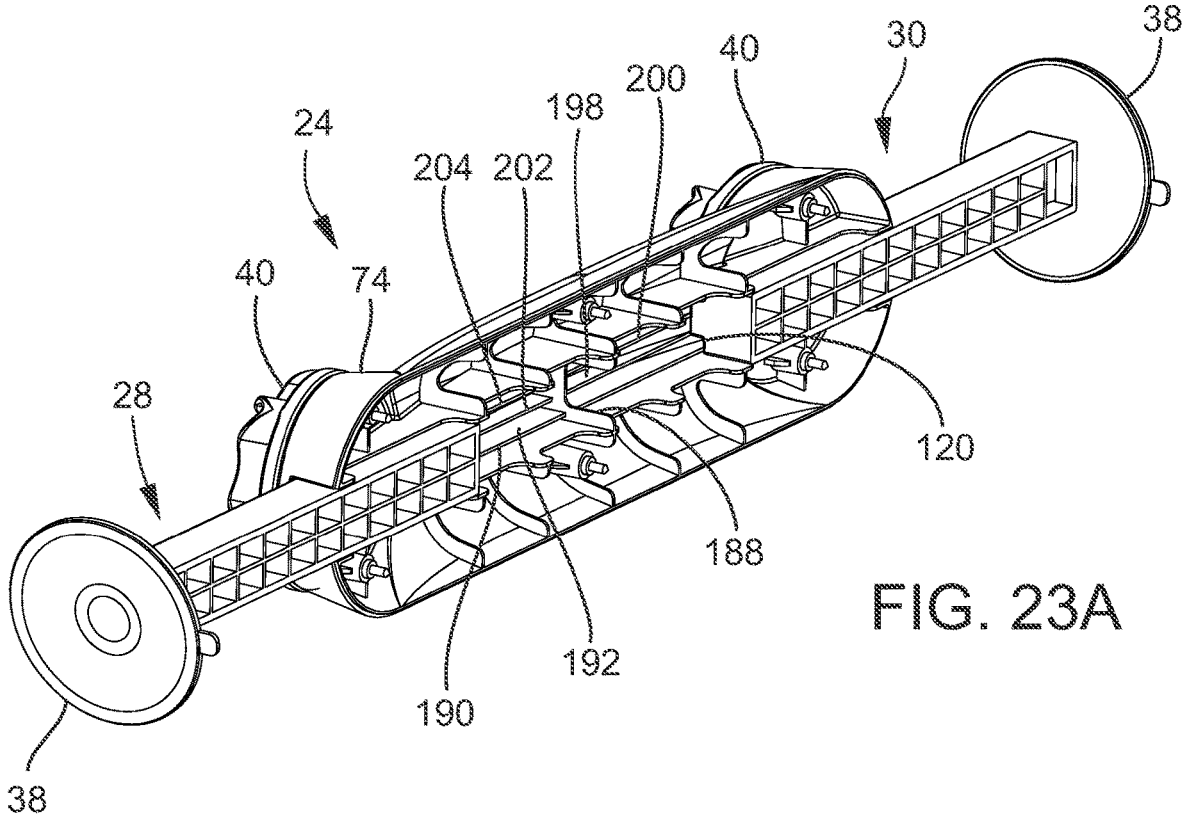
FIG. 23A is a perspective, assembled, rear view of the front end of the bath seat apparatus of FIG. 21, where the arms of the bath seat apparatus have been drive out.
Figure 23B:
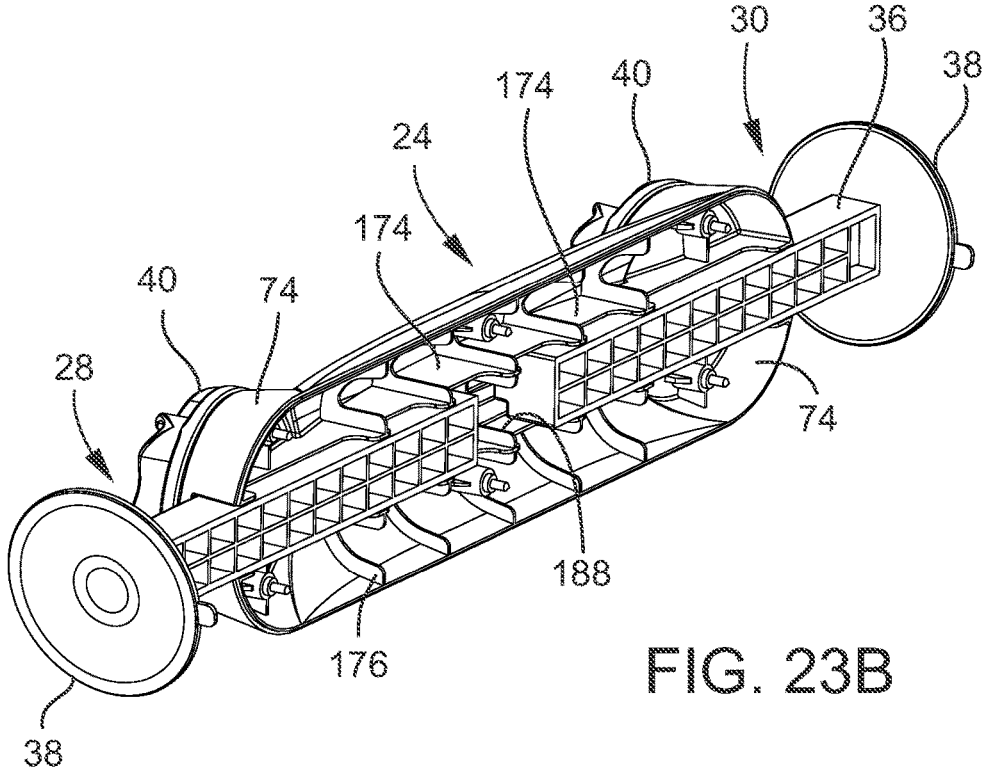

FIG. 23A shows the arms 28, 30 in the receptors 122 and somewhat extended out of the front end frame portion 24. FIG. 23B shows the arms 28, 30 in the receptors 122 and somewhat retracted into the front end frame portion 24. A U-shaped vertically extending stop portion 188 separates the receptor 122 for arm 28 from the receptor 122 for arm 30. FIG. 23A further shows that an inner horizontally extending straight edge 190 of a horizontally extending rib 192 guides and confronts the lower elongate face 120 of the rack portion 36. This inner straight edge 190 and horizontally extending rib 192 is also shown in FIG. 21. FIG. 22 shows a horizontally extending straight edge 194 of a horizontally extending rib 196 that guides and confronts the upper elongate face 118 of the rack portion 36.

FIG. 23A further shows horizontally extending ribs 198, 200 having respective straight horizontally extending inner edges 202, 204. These inner edges 202, 204 confront the rack teeth 116 as the rack portion 36 slides back and forth in the receptor 122.

FIG. 23B shows the arms 28 and 30 having been drawn in by the pinions 40 to where the distal ends of the arms 28, 30 are adjacent to, but not yet making contact with, the U-shaped stop portion 188. This U-shaped stop portion 188 has an upper rearwardly extending plate portion and a lower rearwardly extending plate portion, which plate portions are disposed in a common vertical plane.

Figure 24A:
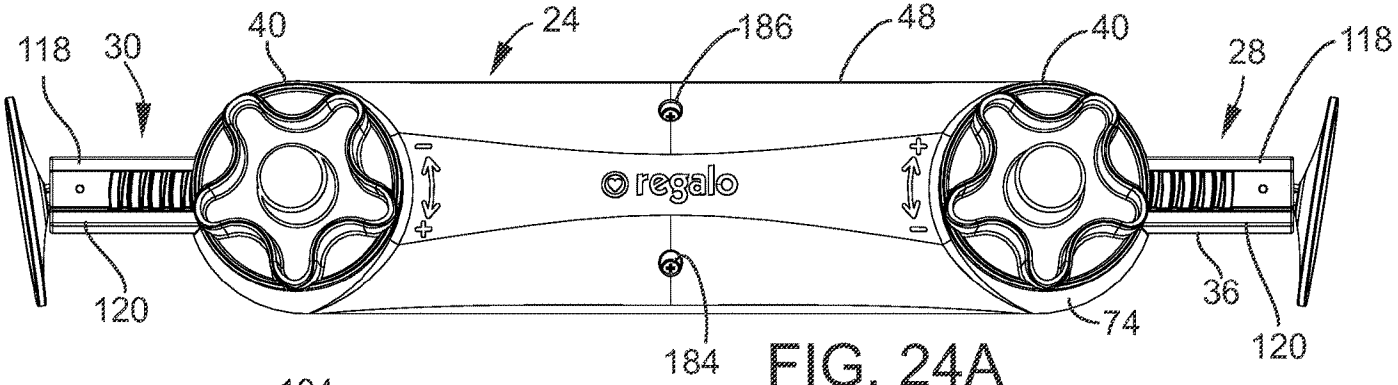
FIG. 24A is an elevation front view of the front end of the bath seat apparatus of FIG. 23A.
Figure 24B:
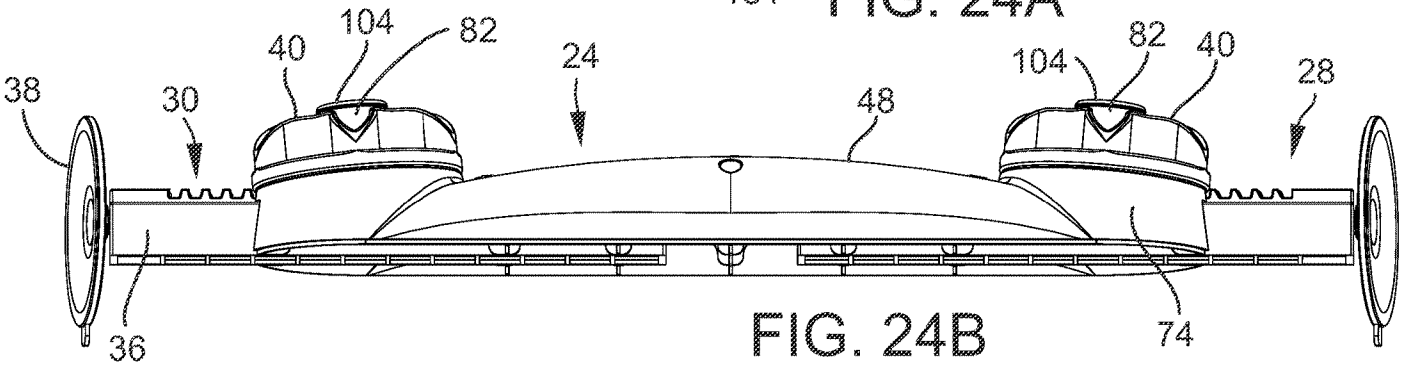
FIG. 24B is top view of the front end of the bath seat apparatus of FIG. 24A.
Figure 24C:
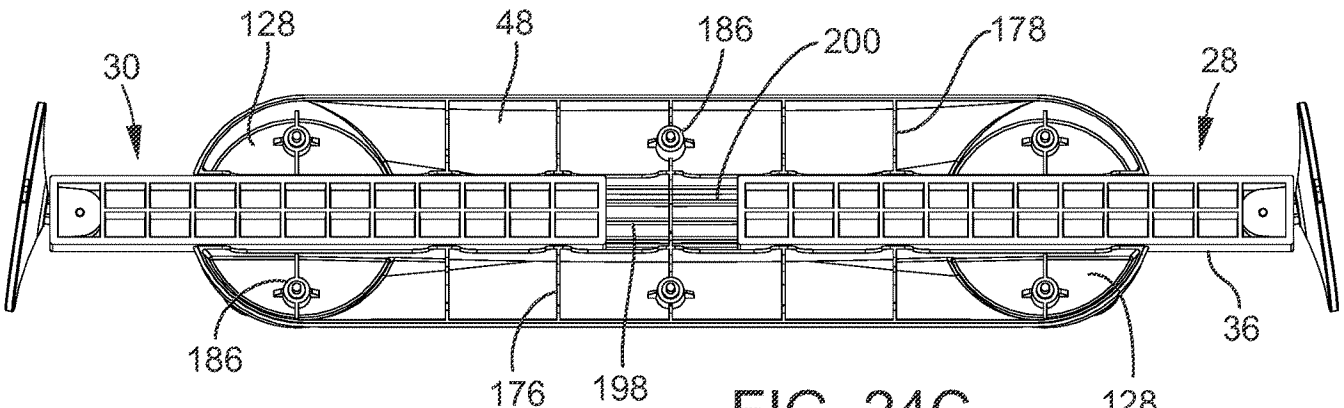

FIGS. 24A, 24B, and 24C are slightly perspective views and show the front end frame portion 24 as the front end frame portion 24 rotates from FIG. 24A to FIG. 24B to FIG. 24C. FIG. 24B shows that the axis of rotation of the pinion 40, and the axis of the frustoconical portion 82, which axes are coaxial, are oblique to the axial axis of the rack portions 36 that such pinions 40 engage. FIG. 24C shows the set of five vertically extending lower ribs 176, the set of five vertically extending upper ribs 178, and the two horizontally extending ribs 198, 200, the inner edges 202, 204 of which confront the tips of the rack teeth 116.

Figure 25A:
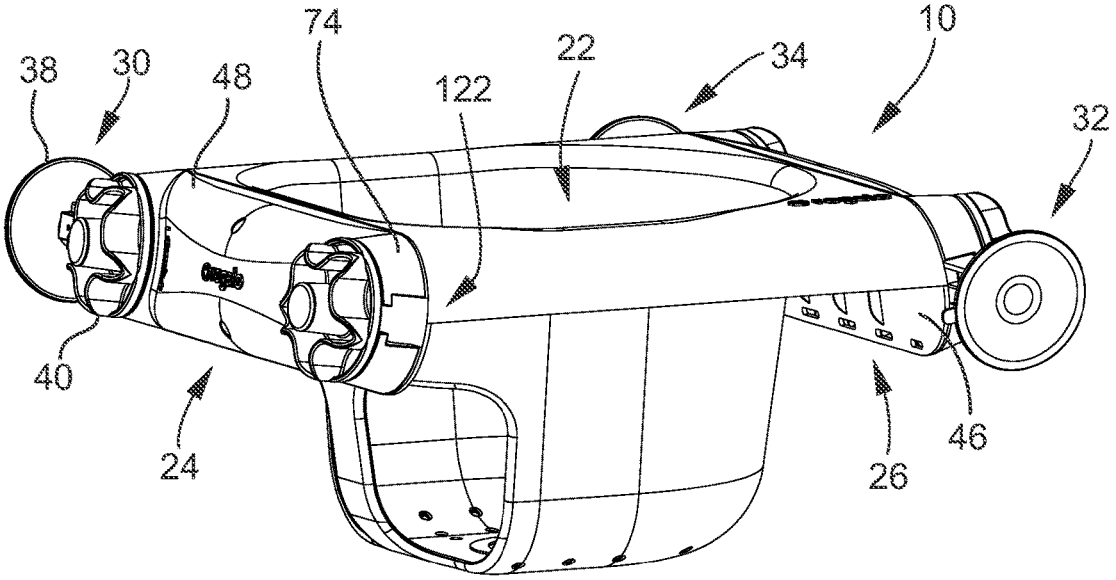
FIG. 25A is a side perspective view of the bath seat apparatus of FIG. 5 with one of the arm assemblies removed.

FIG. 25A is a perspective view of the bath seat apparatus 10 with arm 28 removed so as to show the open end of one receptor 122. It should be noted that the arms 28, 30, 32, 34 do not wobble when in their respective receptor 122. Each of the arms 28, 30, 32, 34 is captured and restrained from wobbling by the frame 18 confronting all sides of the rack portion 36. In other words, top side 108 of rack portion 36 confronts horizontally extending frame portion 174, bottom side 110 of rack portion 36 confronts horizontally extending frame portion 126, vertical plate portion 46 confronts the exposed rib side 122, ribs 198, 202 confront the rack teeth 116, horizontally extending lower rib 192 confronts the lower elongate face 120 extending along the rack teeth 116, and horizontally extending upper rib 196 confronts the upper elongate face 118 running along the rack teeth 116. Further, the edges of the opening of the receptor 122, which opening is formed in partially cylindrical portion 74, act to guide all seven faces of each of the arms 28, 30, 32, 34.

Figure 25B:
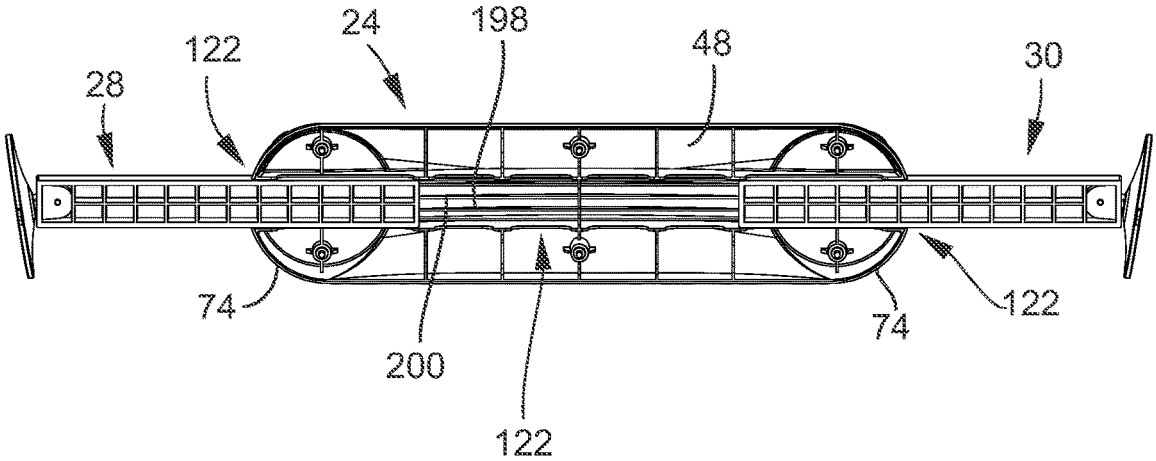
FIG. 25B is a rear elevation view of the front end of the bath seat apparatus of FIG. 24A with the arms driven out.

FIG. 25B shows a rear view of the front end frame portion 24 with the arms 28, 30 partially drawn in. FIG. 25B relates to FIG. 24C that also shows a rear view of the front end frame portion 24 but with the arms 28, 30 partially extended out. FIG. 25B shows the horizontally extending ribs 198, 200 that confront the rack teeth 116.

FIG. 26 shows that the platform 128, upon which the teeth 86, 88 of the pinion 40 ride, includes a slot 206 for receiving the rack teeth 116. Platform 128 is one-piece and integral with partially cylindrical portion 74, which is one-piece and integral with outer frame section 48 of front end frame portion 24. Platform 128 is formed in the shape of a disk and defines a plane that is oblique to the axial axis of the rack portion 37, that is at a right angle to the axis of rotation of pinion 40, and that is at a right angle to frustoconical portions 82, 102, where frustoconical portion 82 of pinion 40 rides up upon and rotates on frustoconcial portion 102. Frustoconical portion 102 is one-piece and integral with platform 128. Slot 206 has an outward portion 208 disposed outwardly of frustoconical portion 102 and an inward portion 210 disposed inwardly of frustoconcial portion 102. Rack teeth 116 extend through such outward portion 208 and are engaged by the pinion teeth 86, 88. Rack teeth 116 do not extend sufficiently through the inward portion 210 to be engaged by the pinion teeth 86, 88, which rotate over the rack teeth 116. At the innermost end of the slot 206, the slot 206 is no longer required because of the cant or obliqueness of the platform 128. If the inward portion 210 not provided, the rack teeth 116 would scrape away at the bottom face of the platform 128.

FIG. 26 further shows that inner plate section 46 includes a set of six pin receptors 212 for pin connectors 184. Pin receptors 212 are one-piece and integral with inner plate section 46. An upper straight ridge 214 interconnects a set of three upper pin receptors 212 and a lower straight ridge 214 interconnects a set of three lower pin receptors 212. Each of the straight ridges 214 may act as a locator that engages a groove or other frame part on the front end frame portion 24.

FIG. 27 shows the rack teeth 116 extending through the outer portion 208 of the slot 206 to engage the pinion teeth 86, 88, which rack teeth 116 are visible through the inner portion 210 of slot 206 but which rack teeth 116 do not extend fully through the slot 206.

FIG. 27 further shows the pin pockets or receptors 186 that permit the pin connectors 184 to be inset in the platform 128, which pin connectors 184 then engage pin receptors 212 on the inner plate section 46.

FIG. 27 further shows that the platform 128 includes a frontwardly or outwardly extending cylindrical peripheral lip 218. The base 78 of the pinion 40 rides on this peripheral lip 218 while portions of the pinion teeth 86, 88 engage rack teeth 116, while portions of the pinion teeth 86, 88 ride on the face 216 of platform 128, and while portions of the pinion teeth 86, 88 slide over the inner portion 210 of slot 206 to move over rack teeth 86, 88 without engaging such rack teeth 116. Outer portion 208 of slot 206 is partially formed in the sidewall of cylindrical portion 74 such that peripheral lip 218 does not extend continuously about the platform 128.

FIG. 28 shows the front end frame portion 24 engaged to the inner plate section 46, with one pinion 40 broken away to show the platform 128 upon which the pinion teeth 86, 88 ride when the pinion teeth 86, 88 are not engaging the rack teeth 116. The platform 128 includes a face 216 that is smooth and flat. The heads of pins 184 are set inwardly of the face 216 when the pins 184 are in the pin pockets or receptors 186.

In operation, unless already in a retracted state, the arms 28, 30, 32, 34 of the bath seat apparatus 10 are retracted prior to the bath seat apparatus 10 being placed in the bath tub 12. The arms 28, 30, 32, 34 are retracted by rotating the pinions 40. Since the pinions 40 operate as a lock when in a nonrotating state, the arms 28, 30, 32, 34 may not be retracted or extended by, for example, the caretaker pushing in on the arms 28, 30, 32, 34 or by the caretaker pulling out on the arms 28, 30, 32, 34. Then, without the child in the bath seat apparatus 10, the bath seat apparatus 10 is set in the bath tub 12. Water may or may not already be in the bath tub 12 at this point in time. The bath seat apparatus 10 is set in the bath tub 12 such that the bottommost edge 64 and bottommost edges of the ribs 158, 160 rest upon the inside bottom 16 of the bath tub 12. Then the pinions 40 are rotated to extend the arms 28, 30, 32, 34 until the suction cups 140 are adjacent to the sides 14 of the bath tub 12. At this point in time the arms 28, 30, 32, 34 have been extended about the same distance. Then the pinions 40 of opposite arms 28, 30 are rotated at the same time or different times such that their respective suction cups 140 engage in an operative suction manner the bath tub inner sides 14, where air is expelled from the suction cups 140, such that the suction cups 140 and their respective arms 28, 30 are engaged to the bath tub 12, where the bottommost edge 64 and bottommost edges of the ribs 158, 160 continue to rest upon the bath tub inside bottom 16. Then this same operation is carried out with opposite arms 32, 34 such that bath seat apparatus 10 is fully engaged with the bath tub 10. Then a child may be placed in the child receptacle 22. When in the child receptacle 22, the child may have difficulty reaching the pinions 40 that are facing away from the child. The child will further have difficulty in disengaging the arms 28, 30, 32, 34 and their respective suction cups 140 from the sides 14 of the bath tub 12 by his or her movements in the child receptacle 22 because of the five regions of contact that the bath seat apparatus 10 has with the bath tub 12, where such five points of contact are 1) arm 28, 2) arm 30, 3) arm 32, 4) arm 34, and 5) the bottommost edge 64 and the bottommost edges of the ribs 158, 160. When in the child receptacle 22, the child's legs extend through the leg openings 54, 56 and the feet of the child are on or adjacent to the inside bottom 16 of the bath tub 12. When the bath is complete, the child is lifted out of the child receptacle 22. Then the suction cups 140 are disengaged from the inside walls 14 by pulling on the tabs 172 of the suction cups 140 and/or rotating the pinions 40 the opposite way to retract the arms 28, 30, 32, and 34 to disengage the suction cups 140 from the inside walls 14 of the bath tub 12. If desired, the suction cup tabs 172 may be pulled first to disengage the suction cups 140 from the inside sides of the bath tub 12 and then, subsequently, the pinions 40 may be rotated to retract the arms 28, 30, 32, 34. Then the bath seat apparatus 10 may be lifted up but not laterally out of the bath tub 12 such that water drains through the perforations 68 and flows downwardly back into the bath tub 12. Then the bath seat apparatus 10 may be lifted out of the bath tub 12 laterally or longitudinally and stored with the arms 28, 30, 32, 34 fully retracted by rotating the pinions 40 to a position where the distal ends 143 are adjacent to their respective pinions 40.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A bath seat apparatus for being engaged in a bath tub, the bath tub having first and second sides and a bottom, the bath seat apparatus comprising:

a) a frame having a receptacle for a child;

b) a first arm extending from the frame and having a distal end for engaging the first side of the bath tub;

c) a second arm extending from the frame and having a distal end for engaging the second side of the bath tub;

d) a third arm extending from the frame and having a distal end for engaging the first side of the bath tub;
e) a fourth arm extending from the frame and having a distal end for engaging the second side of the bath tub;
f) a first driver engaged to the frame that drives the first arm to and away from the frame;
g) a second driver engaged to the frame that drives the second arm to and away from the frame;
h) a third driver engaged to the frame that drives the third arm to and away from the frame;
i) a fourth driver engaged to the frame that drives the fourth arm to and away from the frame;
j) wherein the first, second, third, and fourth drivers are, respectively, first, second, third, and fourth gear assemblies;
k) wherein the first, second, third, and fourth gear assemblies include, respectively, first, second, third, and fourth pinons engaged to the frame;
l) The first, second, third, and fourth gear assemblies include, respectively, first, second, third, and fourth racks;
m) wherein the first arm includes the first rack, the second arm includes the second rack, the third arm includes the third rack, and the fourth arm includes the fourth rack; and
n) wherein each of the first, second, third, and fourth pinions includes a face having an axis and a periphery, the pinon rotatable on the axis, the face having a first elongate spiral tooth having an inner end and an outer end, the inner end of the first elongate spiral tooth being adjacent to the axis, the outer end of the first elongate spiral tooth being adjacent to the periphery.

2. The bath seat apparatus of claim 1, wherein the first arm includes a first straight axis and wherein the second arm includes a second straight axis, the first and second axis being coaxial.

3. The bath seat apparatus of claim 1, wherein the third arm includes a third straight axis and wherein the fourth arm includes a fourth straight axis, the third and fourth axis being coaxial.

4. The bath seat apparatus of claim 1, wherein said face includes a second elongate spiral tooth having an inner end and an outer end, the inner end of the second elongate spiral tooth being adjacent to the axis, the outer end of the second elongate spiral tooth being adjacent to the periphery, the first and second elongate spiral teeth being spaced apart from each other, a portion of the first elongate spiral tooth being disposed between the second elongate spiral tooth and the periphery, and a portion of the second elongate spiral tooth being disposed between the first elongate spiral tooth and the periphery.

5. The bath seat apparatus of claim 1, wherein the frame includes a front end and a rear end, the first and second arms extending from the front end, the third and fourth arms extending from the rear end, the receptacle being between the front and rear ends, the receptacle having a bottom that faces the bottom of the bath tub, the receptacle having a pair of leg openings for the child, the leg openings being spaced apart from each other.

6. The bath seat apparatus of claim 1, wherein the frame includes a front end and a rear end, the first and second arms extending from the front end, the third and fourth arms extending from the rear end, the receptacle being between the front and rear ends, the receptacle having a bottom that faces the bottom of the bath tub, the bottom including a bottom portion, the bottom portion being disposed at a first elevation, the receptacle having a seat that is spaced from the bottom portion, the seat having perforations to permit water to pass through the seat, the perforations being at a greater elevation than the first elevation.

7. The bath seat apparatus of claim 1, wherein the frame includes a front end and a rear end, the first and second arms extending from the front end, the third and fourth arms extending from the rear end, the receptacle being between the front and rear ends, the receptacle having a bottom that faces the bottom of the bath tub, the bottom including a bottom portion, the bottom portion being disposed at a first elevation, the receptacle having a seat that is spaced from the bottom portion, the seat bearing a weight of the child and being disposed at a greater elevation or being disposed over greater elevations than the first elevation.

8. The bath seat apparatus of claim 1, wherein the first, second, third, and fourth drivers include respective first, second, third, and fourth rotatable hand controls that when rotated drive the respective first, second, third, and fourth arms in a straight direction to and away from the frame, the first, second, third, and fourth distal ends being driveable in to a position that is adjacent to the respective first, second, third, or fourth hand control that is driving said respective first, second, third, or fourth distal end.

9. The bath seat apparatus of claim 1, wherein:
a) each of the first, second, third, and fourth racks includes a set of teeth; and
b) a first portion of said first elongate spiral tooth of said first, second, third, and fourth pinions engages respectively said set of teeth of said first, second, third, and fourth racks and, at the same time, a second portion of said first elongate spiral tooth of said first, second, third, and fourth pinions is disposed respectively adjacent to and over said set of teeth of said first, second, third, and fourth racks.

10. The bath seat apparatus of claim 1, wherein each of the first, second, third, and fourth distal ends includes a suction cup for engaging one of the first and second sides of the bath tub.

11. The bath seat apparatus of claim 1, wherein:
a) the first pinion when in a rotating state engaging and driving the first rack to drive the first arm to and away from the frame, the first pinion when in a nonrotating state engaging and locking the first rack against axial sliding to lock the first arm from being driven to and away from the frame, the first pinion unlocking the first rack for axial sliding and the first arm for being driven to and away from the frame when the first pinion begins to rotate;
b) the second pinion when in a rotating state engaging and driving the second rack to drive the second arm to and away from the frame, the second pinion when in a nonrotating state engaging and locking the second rack against axial sliding to lock the second arm from being driven to and away from the frame, the second pinion unlocking the second rack for axial sliding and the second arm for being driven to and away from the frame when the second pinion begins to rotate;
c) the third pinion when in a rotating state engaging and driving the third rack to drive the third arm to and away from the frame, the third pinion when in a nonrotating state engaging and locking the third rack against axial sliding to lock the third arm from being driven to and away from the frame, the third pinion unlocking the third rack for axial sliding and the third arm for being driven to and away from the frame when the third pinion begins to rotate; and d) the fourth pinion when in a rotating state engaging and driving the fourth rack to drive the fourth arm to and away from the frame, the fourth pinion when in a nonrotating state engaging and locking the fourth rack against axial sliding to lock the fourth arm from being driven to and away from the frame, the fourth pinion unlocking the fourth rack for axial sliding and the fourth arm for being driven to and away from the frame when the fourth pinion begins to rotate.

12. A bath seat apparatus for being engaged in a bath tub, the bath tub having first and second sides and a bottom, the bath seat apparatus comprising:

a) a frame having a receptacle for a child;

b) a first arm extending from the frame and having a distal end for engaging the first side of the bath tub;

c) a second arm extending from the frame and having a distal end for engaging the second side of the bath tub;

d) a third arm extending from the frame and having a distal end for engaging the first side of the bath tub;

e) a fourth arm extending from the frame and having a distal end for engaging the second side of the bath tub;

f) a first driver engaged to the frame that drives the first arm to and away from the frame;

g) a second driver engaged to the frame that drives the second arm to and away from the frame;

h) a third driver engaged to the frame that drives the third arm to and away from the frame;

i) a fourth driver engaged to the frame that drives the fourth arm to and away from the frame;

j) wherein the first, second, third, and fourth drivers are, respectively, first, second, third, and fourth gear assemblies;

k) wherein the first, second, third, and fourth gear assemblies include, respectively, first, second, third, and fourth pinons engaged to the frame;

l) The first, second, third, and fourth gear assemblies include, respectively, first, second, third, and fourth racks;

m) wherein the first arm includes the first rack, the second arm includes the second rack, the third arm includes the third rack, and the fourth arm includes the fourth rack; and n) wherein each of the first, second, third, and fourth racks includes a set of teeth, each of the teeth includes first and second ends, a top extending between the first and second ends, a first side extending between the first and second ends and extending from the top, and a second side extending between the first and second ends and extending from the top, and wherein each of the first and second sides is curved from the first end to the second end.

13. A bath seat apparatus for being engaged in a bath tub, the bath tub having first and second sides and a bottom, the bath seat apparatus comprising:

a) a frame having a receptacle for a child;

b) a first arm extending from the frame and having a distal end for engaging the first side of the bath tub;

c) a second arm extending from the frame and having a distal end for engaging the second side of the bath tub;

d) a third arm extending from the frame and having a distal end for engaging the first side of the bath tub;

e) a fourth arm extending from the frame and having a distal end for engaging the second side of the bath tub;

f) a first driver engaged to the frame that drives the first arm to and away from the frame;

g) a second driver engaged to the frame that drives the second arm to and away from the frame;

h) a third driver engaged to the frame that drives the third arm to and away from the frame;

i) a fourth driver engaged to the frame that drives the fourth arm to and away from the frame; and j) wherein the first, second, third, and fourth drivers include respective first, second, third, and fourth rotatable hand controls that when rotated drive the respective first, second, third, and fourth arms in a straight direction to and away from the frame, the first and second hand controls facing in a direction forwardly of the receptacle to minimize chances of a child operating the first and second hand controls, the third and fourth hand controls facing in a direction rearwardly of the receptacle to minimize chances of a child operating the third and fourth hand controls.

14. A bath seat apparatus for being engaged in a bath tub, the bath tub having first and second sides and a bottom, the bath seat apparatus comprising:

a) a frame having a receptacle for a child;

b) a first arm extending from the frame and having a distal end for engaging the first side of the bath tub;

c) a second arm extending from the frame and having a distal end for engaging the second side of the bath tub;

d) a third arm extending from the frame and having a distal end for engaging the first side of the bath tub;

e) a fourth arm extending from the frame and having a distal end for engaging the second side of the bath tub;

f) a first driver engaged to the frame that drives the first arm to and away from the frame;

g) a second driver engaged to the frame that drives the second arm to and away from the frame;

h) a third driver engaged to the frame that drives the third arm to and away from the frame;

i) a fourth driver engaged to the frame that drives the fourth arm to and away from the frame;

j) wherein the first, second, third, and fourth drivers are, respectively, first, second, third, and fourth gear assemblies;

k) wherein the first, second, third, and fourth gear assemblies include, respectively, first, second, third, and fourth pinons engaged to the frame;

l) The first, second, third, and fourth gear assemblies include, respectively, first, second, third, and fourth racks;

m) wherein the first arm includes the first rack, the second arm includes the second rack, the third arm includes the third rack, and the fourth arm includes the fourth rack;

n) wherein each of the first, second, third, and fourth pinions includes a face that defines a plane, the face having an elongate tooth that engages one of the first, second, third, or fourth racks;

o) wherein each of the first, second, third, and fourth racks includes an axis on which said rack axially slides; and p) wherein said face is obliquely disposed relative to said axis such that when a portion of said elongate tooth engages its respective rack another portion of said elongate tooth is disposed over said rack in a position that is disengaged from its respective rack.

15. A bath seat apparatus for being engaged in a bath tub, the bath tub having first and second sides and a bottom, the bath seat apparatus comprising:

a) a frame having a receptacle for a child;

b) a first arm extending from the frame and having a distal end for engaging the first side of the bath tub;

c) a second arm extending from the frame and having a distal end for engaging the second side of the bath tub;

d) a third arm extending from the frame and having a distal end for engaging the first side of the bath tub;
e) a fourth arm extending from the frame and having a distal end for engaging the second side of the bath tub;
f) a first driver engaged to the frame that drives the first arm to and away from the frame;
g) a second driver engaged to the frame that drives the second arm to and away from the frame;
h) a third driver engaged to the frame that drives the third arm to and away from the frame;
i) a fourth driver engaged to the frame that drives the fourth arm to and away from the frame;
j) wherein the first, second, third, and fourth drivers are, respectively, first, second, third, and fourth gear assemblies;
k) wherein the first, second, third, and fourth gear assemblies include, respectively, first, second, third, and fourth pinons engaged to the frame;
l) the first, second, third, and fourth gear assemblies include, respectively, first, second, third, and fourth racks;
m) wherein the first arm includes the first rack, the second arm includes the second rack, the third arm includes the third rack, and the fourth arm includes the fourth rack;
n) wherein each of the first, second, third, and fourth pinions includes a face that defines a plane, the face having an elongate tooth that engages one of the first, second, third, or fourth racks;
o) wherein each of the first, second, third, and fourth racks includes a rack axis on which said rack axially slides; and
p) wherein each of the first, second, third, and fourth pinions includes a pinion axis about which said pinion rotates, said pinion axis being oblique relative to its respective rack axis face such that when a portion of said elongate tooth engages its respective rack another portion of said elongate tooth is disposed over said rack in a position that is disengaged from its respective rack.

16. A bath seat apparatus for being engaged in a bath tub, the bath tub having first and second sides and a bottom, the bath seat apparatus comprising:
a) a frame having a receptacle for a child;
b) a first arm extending from the frame and having a distal end for engaging the first side of the bath tub;
c) a second arm extending from the frame and having a distal end for engaging the second side of the bath tub;
d) a third arm extending from the frame and having a distal end for engaging the first side of the bath tub;
e) a fourth arm extending from the frame and having a distal end for engaging the second side of the bath tub;
f) a first gear assembly engaged to the frame that drives the first arm to and away from the frame;
g) a second gear assembly engaged to the frame that drives the second arm to and away from the frame;
h) a third gear assembly engaged to the frame that drives the third arm to and away from the frame;
i) a fourth gear assembly engaged to the frame that drives the fourth arm to and away from the frame;
j) each of the first, second, third, and fourth gear assemblies including a pinion and rack;
k) the pinion including a face defining a plane and an elongate spiral tooth on the face;
l) The rack including a set of teeth, each of the teeth having first and second ends and defining an arc from the first end to the second end; and
m) a first portion of said elongate spiral tooth engaging said set of teeth on said rack while, at the same time, a second portion of said elongate spiral tooth is i) disengaged from said set of teeth, ii) disposed adjacent to the set of teeth, and iii) disposed directly over said set of teeth.

17. A bath seat apparatus for being engaged in a bath tub, the bath tub having first and second sides and a bottom, the bath seat apparatus comprising:
a) a frame having a receptacle for a child;
b) a first arm extending from the frame and having a distal end for engaging the first side of the bath tub;
c) a second arm extending from the frame and having a distal end for engaging the second side of the bath tub;
d) a third arm extending from the frame and having a distal end for engaging the first side of the bath tub;
e) a fourth arm extending from the frame and having a distal end for engaging the second side of the bath tub;
f) a first driver engaged to the frame that drives the first arm to and away from the frame;
g) a second driver engaged to the frame that drives the second arm to and away from the frame;
h) a third driver engaged to the frame that drives the third arm to and away from the frame; and
i) a fourth driver engaged to the frame that drives the fourth arm to and away from the frame;
j) wherein the first arm includes a first straight axis and wherein the second arm includes a second straight axis, the first and second axis being coaxial;
k) wherein the third arm includes a third straight axis and wherein the fourth arm includes a fourth straight axis, the third and fourth axis being coaxial;
l) Wherein the first, second, third, and fourth drivers include respective first, second, third, and fourth rotatable hand controls that when rotated drive the respective first, second, third, and fourth arms in a straight direction to and away from the frame, the first and second hand controls facing in a direction forwardly of the receptacle to minimize chances of a child operating the first and second hand controls, the third and fourth hand controls facing in a direction rearwardly of the receptacle to minimize chances of a child operating the third and fourth hand controls; and
m) wherein the first, second, third, and fourth distal ends are driveable in to a position that is adjacent to the respective first, second, third, or fourth hand control that is driving said respective first, second, third, or fourth distal end.

* * * * *